US008551911B2

(12) United States Patent
Sakai et al.

(10) Patent No.: US 8,551,911 B2
(45) Date of Patent: Oct. 8, 2013

(54) RECORDING MATERIAL USING PHENOLIC COMPOUND

(75) Inventors: Hiroshi Sakai, Ichihara (JP); Toshio Aihara, Odawara (JP); Satoshi Kodama, Ichihara (JP); Shuntaro Kinoshita, Ichihara (JP); Kazumi Jyujyo, Ichihara (JP); Tadahiro Kondo, Ichihara (JP)

(73) Assignee: Nippon Soda Co., Ltd., Tokyo (JP)

( * ) Notice: Subject to any disclaimer, the term of this patent is extended or adjusted under 35 U.S.C. 154(b) by 0 days.

(21) Appl. No.: 13/261,235

(22) PCT Filed: Sep. 27, 2010

(86) PCT No.: PCT/JP2010/005788

§ 371 (c)(1),
(2), (4) Date: Mar. 27, 2012

(87) PCT Pub. No.: WO2011/039987

PCT Pub. Date: Apr. 7, 2011

(65) Prior Publication Data

US 2012/0186490 A1 Jul. 26, 2012

(30) Foreign Application Priority Data

Sep. 29, 2009 (JP) ..... 2009-224094
Sep. 29, 2009 (JP) ..... 2009-224317
Oct. 16, 2009 (JP) ..... 2009-239571

(51) Int. Cl.
*B41M 5/327* (2006.01)
*B41M 5/333* (2006.01)
*B41M 5/337* (2006.01)

(52) U.S. Cl.
USPC ..... 503/216; 503/209; 503/217; 503/221

(58) Field of Classification Search
None
See application file for complete search history.

(56) References Cited

U.S. PATENT DOCUMENTS

2003/0092941 A1 5/2003 Katsuura et al.
2011/0287931 A1 11/2011 Kodama et al.

FOREIGN PATENT DOCUMENTS

| | | | |
|---|---|---|---|
| CN | 1911908 | A | 2/2007 |
| JP | 05-246924 | A | 9/1993 |
| JP | 06-184047 | A | 7/1994 |
| JP | 08-333329 | A | 12/1996 |
| JP | 10-029969 | A | 2/1998 |
| JP | 10-330350 | A | 12/1998 |
| JP | 2002-307842 | A | 10/2002 |
| JP | 2003-305959 | A | 10/2003 |
| JP | 2004-050649 | A | 2/2004 |
| JP | 2006-327950 | A | 12/2006 |
| JP | 2009-137220 | A | 6/2009 |
| KR | 10-2011-0099341 | A | 9/2011 |

*Primary Examiner* — Bruce H Hess
(74) *Attorney, Agent, or Firm* — Foley & Lardner LLP

(57) ABSTRACT

An object of the present invention is to provide a recording material or a recording sheet that is excellent in background and image stabilities and further excellent in color-developing sensitivity. The recording material of the present invention contains a color-forming compound, an additive, and at least one compound represented by formula (I) [wherein $R^1$ and $R^4$ each independently represent a $C_1$-$C_6$ alkyl group or the like; p represents 0 or any integer of 1 to 4; q represents 0 or any integer of 1 to 5; when p and q represents 2 or more, each of $R^1$ and each of $R^4$ are the same or different; $R^2$ and $R^3$ each independently represent a hydrogen atom or the like; $R^5$ represents a hydrogen atom or the like; and the bond represented by the wavy line represents E, Z, or a mixture thereof].

14 Claims, 3 Drawing Sheets

Example 11
Example 12
Example 13
Example 14
Example 15
Comp. Ex. 7
Concentration
1.50
1.35
1.20
1.05
0.90
0.75
0.60
0.45
0.30
0.15
0.00
0.2
0.7
1.2
1.7
Pulse width Example 16
Example 17
Example 18
Example 19
Example 20
Comp. Ex. 8
Concentration
1.50
1.35
1.20
1.05
0.90
0.75
0.60
0.45
0.30
0.15
0.00
0.2
0.7
1.2
1.7
Pulse width

RECORDING MATERIAL USING PHENOLIC COMPOUND

TECHNICAL FIELD

The present invention relates to a recording material containing a color-forming compound and a color-developing agent and particularly relates to a recording material containing a phenolic compound as a color-developing agent.

CROSS-REFERENCE TO RELATED APPLICATIONS

The present application is a National Stage application of PCT/JP2010/005788, filed Sep. 27, 2010, which claims priority from Japanese Patent Application No. 2009-224317 issued on Sep. 29, 2009, Japanese Patent Application No. 2009-224094 issued on Sep. 29, 2009, and Japanese Patent Application No. 2009-239571 issued on Oct. 16, 2009, and the contents thereof are incorporated herein by reference in their entirety.

BACKGROUND ART

Recording materials that employ color development through the reaction between a color-forming compound and a color-developing agent allow recording in a short time using a relatively simple apparatus without performing complicated treatments such as development and fixation and are thus widely used in thermal recording paper for output recording in facsimiles, printers, etc., or pressure-sensitive copying paper or the like for forms for simultaneous multiple copying. These recording materials are required to immediately develop colors, maintain the whiteness of an uncolored part (hereinafter, referred to as a "background"), and offer the high colorfastness of colored images. Particularly, recording materials excellent in the light resistance of the background are desired in terms of long-term storage stability. For this purpose, attempts have been made to develop color-forming compounds, color-developing agents, storage stabilizers, etc. Nevertheless, recording materials that have well balanced, sufficiently satisfactory color-developing sensitivity, background and image stabilities, etc., have not been found yet.

Also, 2,4'-dihydroxydiphenylsulfone and 4-hydroxy 4'-isopropoxydiphenylsulfone have heretofore been known as recording materials excellent in background stability and are, however, still unsatisfactory in terms of, for example, the light resistance of the background.

The present inventors have already proposed a recording material excellent in the light resistance of the background using a cinnamamide compound as a color-developing agent (see patent document 1). However, this recording material is still not sufficiently satisfactory in terms of, for example, the heat resistance of images, and practical recording materials remain to be obtained.

PRIOR ART DOCUMENT

Patent Document

Patent Document 1: Japanese Unexamined Patent Application Publication No. 2003-305959

SUMMARY OF THE INVENTION

Object to be Solved by the Invention

An object of the present invention is to improve the disadvantages of conventional recording materials as described above and to provide a recording material or a recording sheet that is excellent in background and image stabilities, particularly, the light resistance of the background, further excellent in color-developing sensitivity and exceedingly excellent in the heat resistance, plasticizer resistance, and oil resistance of images.

Means to Solve the Object

The present inventors have conducted diligent. Studies on various color-developing agents used in recording materials and consequently completed the present invention by finding that a recording material that is excellent in color-developing sensitivity and the light resistance of the background, excellent in background and image stabilities, and further excellent in image stability is obtained by using a cinnamamide compound and an additive in combination.

Specifically, the present invention relates to (1) a recording material containing a color-forming compound, the recording material containing at least one compound represented by formula (I) and an additive:

(I)

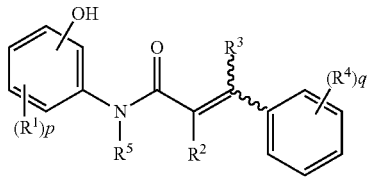

[wherein $R^1$ and $R^4$ each independently represent a hydroxy group, a halogen atom, a $C_1$-$C_6$ alkyl group, or a $C_1$-$C_6$ alkoxy group; p represents 0 or any integer of 1 to 4; q represents 0 or any integer of 1 to 5; when p and q represent 2 or more, each of $R^1$ and each of $R^4$ are the same or different; $R^2$ and $R^3$ each independently represent a hydrogen atom or a $C_1$-$C_6$ alkyl group; $R^5$ represents a hydrogen atom, a $C_1$-$C_6$ alkyl group, an optionally substituted phenyl group, or an optionally substituted benzyl group; and the bond represented by the wavy line represents E, Z, or a mixture thereof], (2) the recording material according to (1), wherein the compound represented by formula (I) is represented by formula (II):

(II)

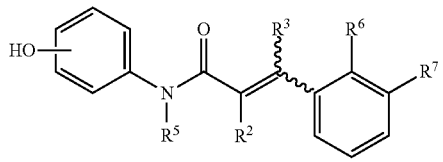

[wherein $R^2$ to are the same as $R^2$ to $R^5$ in formula (I); $R^7$ represents a $C_1$-$C_4$ alkyl group or a $C_1$-$C_4$ alkoxy group; and $R^6$ represents a hydrogen atom when $R^7$ represents a $C_1$-$C_4$ alkyl group, and represents a $C_1$-$C_4$ alkoxy group when $R^7$ represents a $C_1$-$C_4$ alkoxy group], (3) the recording material according to (1), wherein the compound represented by formula (I) is represented by formula (III):

(III)

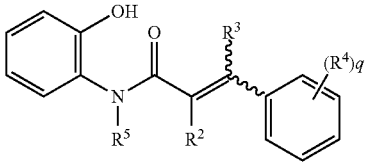

[wherein $R^2$ to $R^5$ are the same as $R^2$ to $R^5$ in formula (I)], (4) the recording material according to any one of (1) to (3), wherein the additive is at least, one compound represented by formula (IV):

(IV)

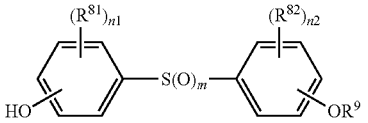

[wherein $R^{81}$ and $R^{82}$ each independently represent a halogen atom, a $C_1$-$C_6$ alkyl group, or a $C_2$-$C_6$ alkenyl group; n1 and n2 each independently represent 0 or any integer of 1 to 4; m represents 0 or any integer of 1 to 2; and $R^9$ represents a $C_1$-$C_6$ alkyl group]

or at least one compound represented by formula (V):

(V)

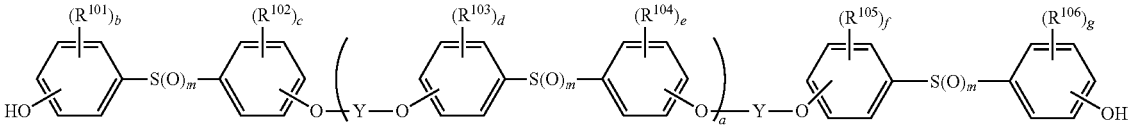

[wherein $R^{101}$ to $R^{106}$ each independently represent a halogen atom, a $C_1$-$C_6$ alkyl group, or a $C_2$-$C_6$ alkenyl group; Y represents a linear or, branched, saturated or unsaturated $C_1$-$C_{12}$ hydrocarbon group. Optionally having an ether bond or the following formula:

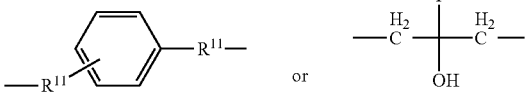

(wherein $R^{11}$ represents a methylene group or an ethylene group, and T represents a hydrogen atom or a $C_1$-$C_4$ alkyl group); b, c, d, e, f, and g each independently represent 0 or any integer of 1 to 4; m represents 0 or any integer of 1 to 2; and a represents 0 or any integer of 1 to 10], (5) the recording material according to (4), wherein the compound represented by formula (IV) is represented by formula (VI):

(VI)

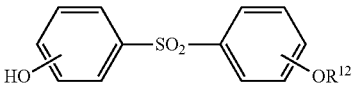

[wherein $R^{12}$ represents a hydrogen atom, a $C_1$-$C_6$ alkyl group, or a $C_2$-$C_6$ alkenyl group], (6) the recording material according to (4), wherein the compound represented by formula (V) is represented by formula (VII):

(VII)

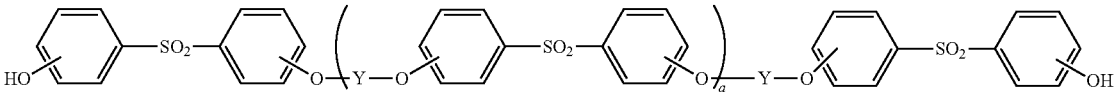

[wherein Y represents a linear or branched, saturated or unsaturated $C_1$-$C_{12}$ hydrocarbon group optionally having an ether bond or the following formula:

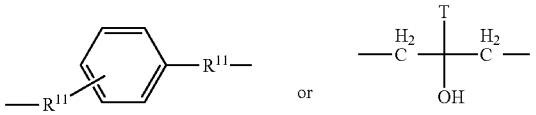

(wherein $R^{11}$ represents a methylene group or an ethylene group, and T represents a hydrogen atom or a $C_1$-$C_4$ alkyl group); and a represents 0 or any integer of 1 to 10], (7) the recording material according to any one of (1) to (3) wherein the additive is an image stabilizer, (8) the recording material according to (7), wherein the image stabilizer is a hindered phenol compound, (9) the recording material according to (8), wherein the image stabilizer is a hindered phenol compound represented by formula (VIII):

(VIII)

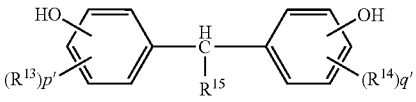

[wherein $R^{13}$ and $R^{14}$ each independently represent a $C_1$-$C_6$ alkyl group; p' and q' each independently represent any integer of 1 to 4; when p' and q' represent 2 or more, each of $R^{13}$ and each of $R^{14}$ are the same or different, provided that at least one of $R^{13}$ and $R^{14}$ represents a $C_1$-$C_6$ alkyl group bonded via secondary or tertiary carbon to the ortho position of the hydroxy group; and $R^{15}$ represents a hydrogen atom or an optionally substituted $C_1$-$C_6$ alkyl group],

(10) the recording material according to (9), wherein $R^{15}$ in the hindered phenol compound represented by formula (VIII) is a compound represented by formula (IX):

(IX)

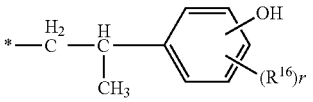

[wherein $R^{16}$ represents a $C_1$-$C_6$ alkyl group; r represents 0 or any integer of 1 to 4; and * represents a binding position],

(11) the recording material according to any one of (1) to (3), wherein the additive is a sensitizer,

(12) the recording material according to any one of (1) to (11), wherein the color-forming compound is a fluoran dye, and

(13) a recording sheet having a recording material layer formed from a recording material according to any one of (1) to (12) on a support.

Effect of the Invention

According to the present invention, a recording material that is excellent in color-developing sensitivity and more excellent in background and image stabilities than ever before can be obtained by combining a particular cinnamamide compound with an additive in a recording material containing a color-forming compound. Particularly, a recording material or a recording sheet that is excellent in the light resistance and moist heat resistance of the background and exceedingly excellent in the heat resistance of images can be obtained.

Figure 1:
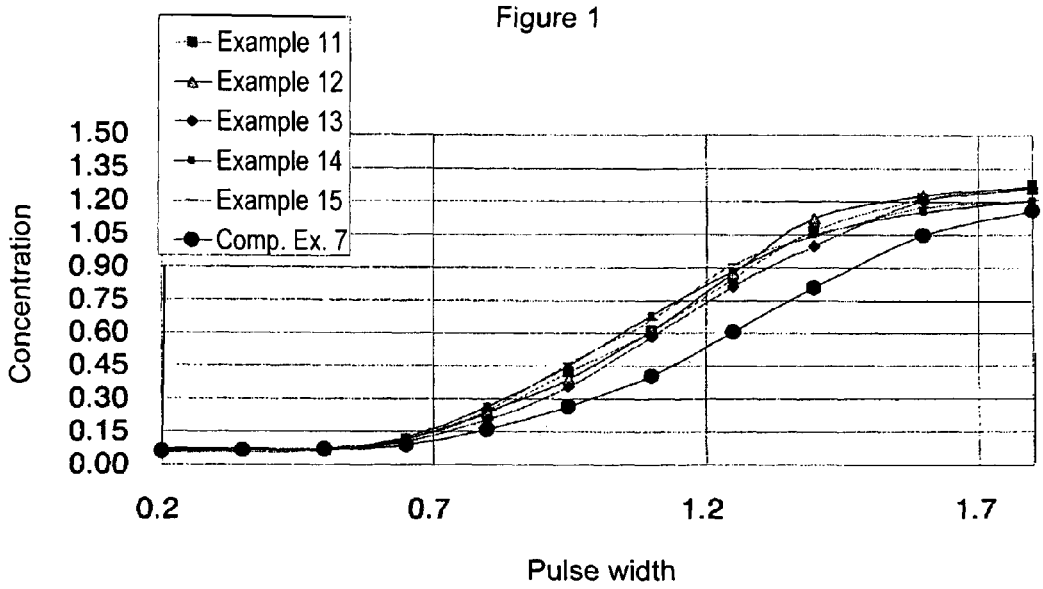
FIG. 1 is a diagram showing results of a dynamic color-developing sensitivity test using each recording paper prepared in Examples 11 to 15 and Comparative Example 7.

MODE FOR CARRYING OUT THE INVENTION (Recording Material)

A recording material of the present invention is a recording material containing a color-forming compound, the recording material containing at least one compound represented by formula (I) and an additive.

(Compound Represented by Formula (I))

In the formula of the compound represented by formula (I), $R^1$ and $R^4$ each independently represent a hydroxy group, a halogen atom, a $C_1$-$C_6$ alkyl group, or a $C_1$-$C_6$ alkoxy group. Specifically, examples of the halogen atom can include a fluorine atom, a chlorine atom, a bromine atom, and an iodine atom. Examples of the $C_1$-$C_6$ alkyl group can include a methyl group, an ethyl group, a n-propyl group, an isopropyl group, a n-butyl group, a sec-butyl group, a t-butyl group, an isobutyl group, a n-pentyl group, an isopentyl group, a neopentyl group, a t-pentyl group, a n-hexyl group, an isohexyl group, a 1-methylpentyl group, and a 2-methylpentyl. Examples of the $C_1$-$C_6$ alkoxy group can include a methoxy group, an ethoxy group, a n-propoxy group, an isopropoxy group, a n-butoxy group, a sec-butoxy group, a t-butoxy group, an isobutoxy group, a n-pentoxy group, an isopentoxy group, a neopentoxy group, a t-pentoxy group, a n-hexoxy group, an isohexoxy group, a 1-methylpentoxy group, and a 2-methylpentoxy group.

$R^2$ and $R^3$ each independently represent a hydrogen atom or a $C_1$-$C_6$ alkyl group. Examples of the $C_1$-$C_6$ alkyl group can specifically include the same as the specific examples of $R^1$.

$R^5$ represents a hydrogen atom, a $C_1$-$C_6$ alkyl group, an optionally substituted phenyl group, or an optionally substituted benzyl group. Examples of the $C_1$-$C_6$ alkyl group can specifically include the same as the specific examples of $R^1$. Examples of the substituent for the optionally substituted phenyl group or the optionally substituted benzyl group can specifically include: a hydroxy group; halogen atoms such as a fluorine atom, a chlorine atom, a bromine atom, and an iodine atom; $C_1$-$C_6$ alkyl groups such as a methyl group, an ethyl group, a n-propyl group, an isopropyl group, a n-butyl group, a sec-butyl group, a t-butyl group, a n-pentyl group, an isopentyl group, a neopentyl group, a t-pentyl group, a n-hexyl group, an isohexyl group, a 1-methylpentyl group, and a 2-methylpentyl group; and $C_1$-$C_6$ alkoxy groups such as a methoxy group, an ethoxy group, a n-propoxy group, an isopropoxy group, a n-butoxy group, a sec-butoxy group, a t-butoxy group, an isobutoxy group, a n-pentoxy group, an isopentoxy-group, a neopentoxy group, a t-pentoxy group, a n-hexoxy group, an isohexoxy group, a 1-methylpentoxy group, and a 2-methylpentoxy group.

The compound represented by the general formula (I) used in the present invention can be obtained by reacting a compound represented by formula (X) with a compound represented by formula (XI) in the presence of a base such as pyridine in an organic solvent such as acetonitrile:

(X)

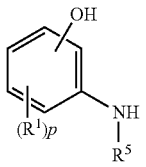

[wherein $R^1$ represents a hydroxy group, a halogen atom, a $C_1$-$C_6$ alkyl group, or a $C_1$-$C_6$ alkoxy group; p represents 0 or any integer of 1 to 4; when p represents 2 or more, each of $R^1$ is the same or different; and $R^5$ represents a hydrogen atom, a $C_1$-$C_6$ alkyl group, an optionally substituted phenyl group, or an optionally substituted benzyl group], and (XI)

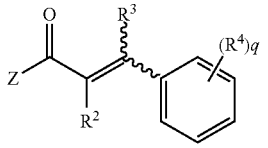

[wherein $R^4$ represents a hydroxy group, a halogen atom, a $C_1$-$C_6$ alkyl group, or a $C_1$-$C_6$ alkoxy group; q represents 0 or any integer of 1 to 5; when q is 2 or more, each of $R^4$ is the same or different; $R^2$ and $R^3$ each independently represent a hydrogen atom or a $C_1$-$C_6$ alkyl group; Z represents a halogen atom such as a chlorine atom, a bromine atom, or an iodine atom; and the bond represented by the wavy line represents an E form, a Z form, or a mixture thereof].

The compound represented by formula (I) has geometric isomers as shown below. Depending on reaction conditions and a purification method, only any one of the isomers may be obtained, or an isomeric mixture may be obtained. These isomers are all included in the scope of the present invention.

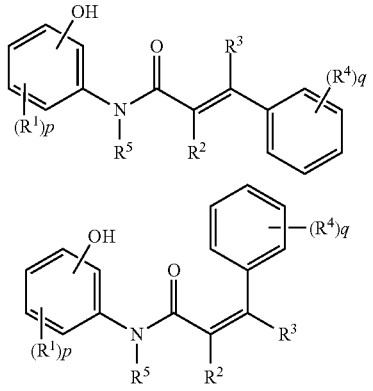

Examples of the compound represented by formula (I) can specifically include compounds described in Table 1.

TABLE 1

(I)

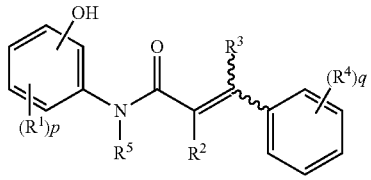

| | OH•(R¹)p | | | | | | | | (R⁴)q | | | | | Melting point |
|---|---|---|---|---|---|---|---|---|---|---|---|---|---|---|
| No | 2- | 3- | 4- | 5- | 6- | $R^5$ | $R^2$ | $R^3$ | 2- | 3- | 4- | 5- | 6- | deg C. |
| 1 | OH | H | H | H | H | H | H | H | H | H | H | H | H | 166-168 |
| 2 | OH | H | H | H | H | Ph | H | H | H | H | H | H | H | |
| 3 | OH | H | H | H | H | H | $CH_3$ | H | H | H | H | H | H | |
| 4 | OH | H | H | H | H | H | H | $CH_3$ | H | H | H | H | H | |
| 5 | OH | H | H | H | H | H | $CH_3$ | $CH_3$ | H | H | H | H | H | |
| 6 | OH | H | H | H | H | H | H | Ph | H | H | H | H | H | |
| 7 | OH | H | H | H | H | H | H | H | OH | H | H | H | H | |
| 8 | OH | H | H | H | H | H | $CH_3$ | H | OH | H | H | H | H | |
| 9 | OH | H | H | H | H | H | H | $CH_3$ | OH | H | H | H | H | |
| 10 | OH | H | H | H | H | H | $CH_3$ | $CH_3$ | OH | H | H | H | H | |
| 11 | OH | H | H | H | H | H | H | H | H | OH | H | H | H | |
| 12 | OH | H | H | H | H | Ph | H | H | H | OH | H | H | H | |
| 13 | OH | H | H | H | H | H | $CH_3$ | H | H | OH | H | H | H | |
| 14 | OH | H | H | H | H | Ph | H | H | H | H | OH | H | H | |
| 15 | OH | H | H | H | H | H | $CH_3$ | H | H | H | OH | H | H | |
| 16 | OH | H | H | H | H | H | H | $CH_3$ | $CH_3$ | H | H | OH | H | |
| 17 | OH | H | OH | H | H | H | H | H | H | H | H | H | H | |
| 18 | OH | H | $CH_3$ | H | H | H | H | H | H | H | H | H | H | |
| 19 | OH | H | H | $CH_3$ | H | H | H | H | H | H | H | H | H | |
| 20 | OH | H | H | H | $CH_3$ | H | H | H | H | H | H | H | H | |
| 21 | OH | H | $OCH_3$ | H | H | H | H | H | H | H | H | H | H | |
| 22 | OH | H | H | Cl | H | H | H | H | H | H | H | H | H | |
| 23 | OH | H | $NO_2$ | H | H | H | H | H | H | H | H | H | H | |
| 24 | OH | H | H | $NO_2$ | H | H | H | H | H | H | H | H | H | |
| 25 | OH | H | H | H | $NO_2$ | H | H | H | H | H | H | H | H | |
| 26 | OH | H | H | H | H | $CH_3$ | H | H | H | H | OH | H | H | |
| 27 | OH | H | H | H | H | $CH_2Ph$ | H | H | H | H | OH | H | H | |
| 28 | OH | H | H | H | H | 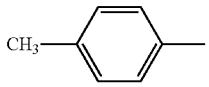 | H | H | H | H | OH | H | H | |
| 29 | OH | H | H | H | H | H | H | H | $CH_3$ | H | H | H | H | 212-213 |
| 30 | OH | H | H | H | H | H | H | H | H | $CH_3$ | H | H | H | 175-177 |
| 31 | OH | H | H | H | H | H | H | H | H | H | $CH_3$ | H | H | 202-204 |
| 32 | OH | H | H | H | H | H | H | H | F | H | H | H | H | |

TABLE 1-continued (I)

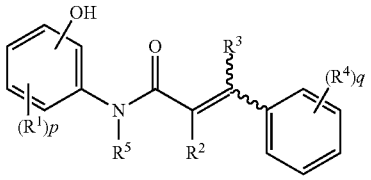

| | OH•(R¹)p | | | | | | | | (R⁴)q | | | | | Melting point |
|---|---|---|---|---|---|---|---|---|---|---|---|---|---|---|
| No | 2- | 3- | 4- | 5- | 6- | $R^5$ | $R^2$ | $R^3$ | 2- | 3- | 4- | 5- | 6- | deg C. |
| 33 | OH | H | H | H | H | H | H | H | H | F | H | H | H | |
| 34 | OH | H | H | H | H | H | H | H | H | H | F | H | H | |
| 35 | OH | H | H | H | H | H | H | H | Cl | H | H | H | H | |
| 36 | OH | H | H | H | H | H | H | H | H | Cl | H | H | H | |
| 37 | OH | H | H | H | H | H | H | H | H | H | Cl | H | H | |
| 38 | OH | H | H | H | H | H | H | H | Br | H | H | H | H | |
| 39 | OH | H | H | H | H | H | H | H | H | Br | H | H | H | |
| 40 | OH | H | H | H | H | H | H | H | H | H | Br | H | H | |
| 41 | OH | H | H | H | H | H | H | H | I | H | H | H | H | |
| 42 | OH | H | H | H | H | H | H | H | H | I | H | H | H | |
| 43 | OH | H | H | H | H | H | H | H | H | H | I | H | H | |
| 44 | OH | H | H | H | H | H | H | H | $NO_2$ | H | H | H | H | |
| 45 | OH | H | H | H | H | H | H | H | H | $NO_2$ | H | H | H | |
| 46 | OH | H | H | H | H | H | H | H | H | H | $NO_2$ | H | H | |
| 47 | OH | H | H | H | H | H | H | H | $OCH_3$ | H | H | H | H | |
| 48 | OH | H | H | H | H | H | H | H | H | $OCH_3$ | H | H | H | |
| 49 | OH | H | H | H | H | H | H | H | H | H | $OCH_3$ | H | H | |
| 50 | OH | H | H | H | H | H | H | H | $OCH_3$ | $OCH_3$ | H | H | H | 196-197 |
| 51 | OH | H | H | H | H | H | H | H | $OCH_3$ | H | H | $OCH_3$ | H | |
| 52 | OH | H | H | H | H | H | H | H | H | $OCH_3$ | $OCH_3$ | H | H | 137-138 |
| 53 | OH | H | H | H | H | H | H | H | $OCH_3$ | $OCH_3$ | $OCH_3$ | H | H | |
| 54 | OH | H | H | H | H | H | H | H | H | $OCH_3$ | $OCH_3$ | $OCH_3$ | H | 208-209 |
| 55 | OH | H | H | H | H | H | H | H | H | H | Ph | H | H | |
| 56 | OH | H | H | H | H | H | H | H | H | OH | OH | H | H | |
| 57 | OH | H | H | H | H | H | H | H | H | OH | $OCH_3$ | H | H | |
| 58 | OH | H | H | H | H | H | H | H | H | Cl | Cl | H | H | |
| 59 | OH | H | H | H | H | H | H | H | Cl | H | Cl | H | H | |
| 60 | OH | H | H | H | H | H | H | H | Cl | H | H | $NO_2$ | H | |
| 61 | OH | H | H | H | H | H | H | H | H | $NO_2$ | Cl | H | H | |
| 62 | H | OH | H | H | H | H | H | H | H | H | H | H | H | 224-225 |
| 63 | H | OH | H | H | H | Ph | H | H | H | H | H | H | H | |
| 64 | H | OH | H | H | H | H | $CH_3$ | H | H | H | H | H | H | |
| 65 | H | OH | H | H | H | H | H | $CH_3$ | H | H | H | H | H | 203-204 |
| 66 | H | OH | H | H | H | H | $CH_3$ | $CH_3$ | H | H | H | H | H | |
| 67 | H | OH | H | H | H | H | H | Ph | H | H | H | H | H | 152-154 |
| 68 | H | OH | H | H | H | H | H | H | OH | H | H | H | H | |
| 69 | H | OH | H | H | H | Ph | H | H | OH | H | H | H | H | 126-127 |
| 70 | H | OH | H | H | H | H | $CH_3$ | H | OH | H | H | H | H | |
| 71 | H | OH | H | H | H | H | $CH_3$ | $CH_3$ | OH | H | H | H | H | |
| 72 | H | OH | H | H | H | H | H | H | H | OH | H | H | H | |
| 73 | H | OH | H | H | H | Ph | H | H | H | OH | H | H | H | |
| 74 | H | OH | H | H | H | H | $CH_3$ | H | H | OH | H | H | H | |
| 75 | H | OH | H | H | H | Ph | H | H | H | OH | H | H | H | |
| 76 | H | OH | H | H | H | H | $CH_3$ | H | H | OH | H | H | H | |
| 77 | H | OH | H | H | H | H | $CH_3$ | $CH_3$ | H | OH | H | H | H | |
| 78 | H | OH | H | H | H | $CH_3$ | H | H | H | OH | H | H | H | |
| 79 | H | OH | H | H | H | $CH_2Ph$ | H | H | H | OH | H | H | H | |
| 80 | H | OH | H | H | H | 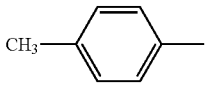 | H | H | H | OH | H | H | H | |
| 81 | H | OH | H | H | H | H | H | H | $CH_3$ | H | H | H | H | 199-200 |
| 82 | H | OH | H | H | H | H | H | H | H | $CH_3$ | H | H | H | 205-207 |
| 83 | H | OH | H | H | H | H | H | H | H | H | $CH_3$ | H | H | 223-225 |
| 84 | H | OH | H | H | H | H | H | H | F | H | H | H | H | |
| 85 | H | OH | H | H | H | H | H | H | H | F | H | H | H | |
| 86 | H | OH | H | H | H | H | H | H | H | H | F | H | H | 217-218 |
| 87 | H | OH | H | H | H | H | H | H | Cl | H | H | H | H | |
| 88 | H | OH | H | H | H | H | H | H | H | Cl | H | H | H | |
| 89 | H | OH | H | H | H | H | H | H | H | H | Cl | H | H | |
| 90 | H | OH | H | H | H | H | H | H | Br | H | H | H | H | |
| 91 | H | OH | H | H | H | H | H | H | H | Br | H | H | H | 189-190 |

TABLE 1-continued (I)

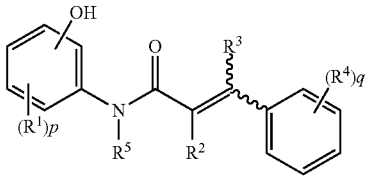

| | OH•(R¹)p | | | | | | | | (R⁴)q | | | | | Melting point |
|---|---|---|---|---|---|---|---|---|---|---|---|---|---|---|
| No | 2- | 3- | 4- | 5- | 6- | $R^5$ | $R^2$ | $R^3$ | 2- | 3- | 4- | 5- | 6- | deg C. |
| 92 | H | OH | H | H | H | H | H | H | H | H | Br | H | H | 222-223 |
| 93 | H | OH | H | H | H | H | H | H | I | H | H | H | H | |
| 94 | H | OH | H | H | H | H | H | H | H | I | H | H | H | |
| 95 | H | OH | H | H | H | H | H | H | H | H | I | H | H | |
| 96 | H | OH | H | H | H | H | H | H | $NO_2$ | H | H | H | H | |
| 97 | H | OH | H | H | H | H | H | H | H | $NO_2$ | H | H | H | |
| 98 | H | OH | H | H | H | H | H | H | H | H | $NO_2$ | H | H | |
| 99 | H | OH | H | H | H | H | H | H | $OCH_3$ | H | H | H | H | 185-188 |
| 100 | H | OH | H | H | H | H | H | H | H | $OCH_3$ | H | H | H | 161-162 |
| 101 | H | OH | H | H | H | H | H | H | H | H | $OCH_3$ | H | H | 218-219 |
| 102 | H | OH | H | H | H | H | H | H | $OCH_3$ | $OCH_3$ | H | H | H | 175-179 |
| 103 | H | OH | H | H | H | H | H | H | $OCH_3$ | H | H | $OCH_3$ | H | 170-171 |
| 104 | H | OH | H | H | H | H | H | H | H | $OCH_3$ | $OCH_3$ | H | H | 209-210 |
| 105 | H | OH | H | H | H | H | H | H | $OCH_3$ | $OCH_3$ | $OCH_3$ | H | H | |
| 106 | H | OH | H | H | H | H | H | H | H | $OCH_3$ | $OCH_3$ | $OCH_3$ | H | 245-246 |
| 107 | H | OH | H | H | H | H | H | H | H | H | Ph | H | H | 253-254 |
| 108 | H | H | OH | H | H | H | H | H | H | H | H | H | H | 209-212 |
| 109 | H | H | OH | H | H | Ph | H | H | H | H | H | H | H | |
| 110 | H | H | OH | H | H | H | $CH_3$ | H | H | H | H | H | H | |
| 111 | H | H | OH | H | H | H | H | $CH_3$ | H | H | H | H | H | |
| 112 | H | H | OH | H | H | H | $CH_3$ | $CH_3$ | H | H | H | H | H | |
| 113 | H | H | OH | H | H | H | H | Ph | H | H | H | H | H | 169-171 |
| 114 | H | H | OH | H | H | H | H | H | OH | H | H | H | H | |
| 115 | H | H | OH | H | H | Ph | H | H | OH | H | H | H | H | |
| 116 | H | H | OH | H | H | H | $CH_3$ | H | OH | H | H | H | H | |
| 117 | H | H | OH | H | H | H | $CH_3$ | $CH_3$ | OH | H | H | H | H | |
| 118 | H | H | OH | H | H | H | H | H | H | OH | H | H | H | |
| 119 | H | H | OH | H | H | Ph | H | H | H | OH | H | H | H | |
| 120 | H | H | OH | H | H | H | $CH_3$ | H | H | OH | H | H | H | |
| 121 | H | H | OH | H | H | Ph | H | H | H | OH | H | H | H | |
| 122 | H | H | OH | H | H | H | $CH_3$ | H | H | OH | H | H | H | |
| 123 | H | H | OH | H | H | H | $CH_3$ | $CH_3$ | H | OH | H | H | H | |
| 124 | H | H | OH | H | H | $CH_3$ | H | H | H | OH | H | H | H | |
| 125 | H | H | OH | H | H | $CH_2Ph$ | H | H | H | OH | H | H | H | |
| 126 | H | H | OH | H | H | 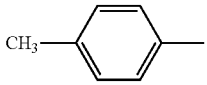 | H | H | H | OH | H | H | H | |
| 127 | H | H | OH | H | H | H | H | H | $CH_3$ | H | H | H | H | 192-194 |
| 128 | H | H | OH | H | H | H | H | H | H | $CH_3$ | H | H | H | 207-208 |
| 129 | H | H | OH | H | H | H | H | H | H | H | $CH_3$ | H | H | 196-198 |
| 130 | H | H | OH | H | H | H | H | H | F | H | H | H | H | |
| 131 | H | H | OH | H | H | H | H | H | H | F | H | H | H | |
| 132 | H | H | OH | H | H | H | H | H | H | H | F | H | H | |
| 133 | H | H | OH | H | H | H | H | H | Cl | H | H | H | H | |
| 134 | H | H | OH | H | H | H | H | H | H | Cl | H | H | H | |
| 135 | H | H | OH | H | H | H | H | H | H | H | Cl | H | H | |
| 136 | H | H | OH | H | H | H | H | H | Br | H | H | H | H | |
| 137 | H | H | OH | H | H | H | H | H | H | Br | H | H | H | |
| 138 | H | H | OH | H | H | H | H | H | H | H | Br | H | H | |
| 139 | H | H | OH | H | H | H | H | H | I | H | H | H | H | |
| 140 | H | H | OH | H | H | H | H | H | H | I | H | H | H | |
| 141 | H | H | OH | H | H | H | H | H | H | H | I | H | H | |
| 142 | H | H | OH | H | H | H | H | H | $NO_2$ | H | H | H | H | |
| 143 | H | H | OH | H | H | H | H | H | H | $NO_2$ | H | H | H | |
| 144 | H | H | OH | H | H | H | H | H | H | H | $NO_2$ | H | H | |
| 145 | H | H | OH | H | H | H | H | H | $OCH_3$ | H | H | H | H | |
| 146 | H | H | OH | H | H | H | H | H | H | $OCH_3$ | H | H | H | 183-184 |
| 147 | H | H | OH | H | H | H | H | H | H | H | $OCH_3$ | H | H | |
| 148 | H | H | OH | H | H | H | H | H | $OCH_3$ | $OCH_3$ | H | H | H | 208-210 |
| 149 | H | H | OH | H | H | H | H | H | $OCH_3$ | H | H | $OCH_3$ | H | 192-194 |
| 150 | H | H | OH | H | H | H | H | H | H | $OCH_3$ | $OCH_3$ | H | H | 223-224 |

TABLE 1-continued (I)

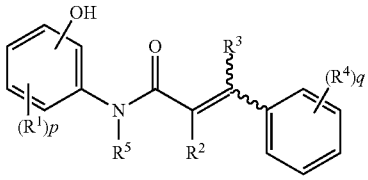

| No | OH•(R¹)p 2- | 3- | 4- | 5- | 6- | R⁵ | R² | R³ | (R⁴)q 2- | 3- | 4- | 5- | 6- | Melting point deg C. |
|---|---|---|---|---|---|---|---|---|---|---|---|---|---|---|
| 151 | H | H | OH | H | H | H | H | H | $OCH_3$ | $OCH_3$ | $OCH_3$ | H | H | |
| 152 | H | H | OH | H | H | H | H | H | H | $OCH_3$ | $OCH_3$ | $OCH_3$ | H | 202-203 |
| 153 | H | H | OH | H | H | H | H | H | H | H | Ph | H | H | |

The compound represented by formula (I) is particularly preferably a compound represented by formula (II):

(II)

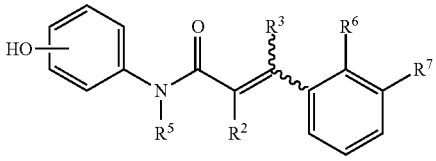

[wherein $R^2$ to $R^5$ are the same as $R^2$ to $R^5$ in formula (I); $R^7$ represents a $C_1$-$C_4$ alkyl group or a $C_1$-$C_4$ alkoxy group; and $R^6$ represents a hydrogen atom when $R^7$ represents a $C_1$-$C_4$ alkyl group, and represents a $C_1$-$C_4$ alkoxy group when $R^7$ represents a $C_1$-$C_4$ alkoxy group].

In formula (II), examples of the $C_1$-$C_4$ alkyl group or the $C_1$-$C_4$ alkoxy group represented by $R^7$ can specifically include, of those exemplified as the specific examples of $R^1$, groups satisfying the condition of $C_1$-$C_4$.

$R^6$ represents a hydrogen atom when $R^7$ represents a $C_1$-$C_4$ alkyl group, and represents a $C_1$-$C_4$ alkoxy group when $R^7$ represents a $C_1$-$C_4$ alkoxy group. Examples of the $C_1$-$C_4$ alkoxy group represented by $R^6$ can specifically include, of those exemplified as the specific examples of $R^1$, groups satisfying the condition of $C_1$-$C_4$.

Examples of the compound represented by formula (II) can more specifically include N-(4-hydroxyphenyl)-3-methylcinnamoylamide, N-(3-hydroxyphenyl)-3-methylcinnamoylamide, and N-(4-hydroxyphenyl)-2,3-dimethoxycinnamoylamide.

Moreover, the compound represented by formula (I) is also particularly preferably a compound represented by formula (III):

(III)

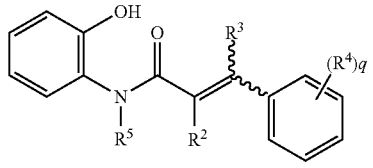

[wherein $R^2$ to $R^5$ are the same as $R^2$ to $R^5$ in formula (I)].

Examples of the compound represented by formula (III) can more specifically include N-(2-hydroxyphenyl)-cinnamoylamide.

These compounds represented by formula (I) can be used alone or in combination of two or more thereof, as needed, as a color-developing agent. The two or more compounds represented by formula (I) can be combined at any ratio.

(Additive)

In the present invention, the additive is a compound that is added to the recording material containing a color-forming compound combined with the particular cinnamamide compound, for the purpose of improving performance, for example, improving color-developing performance or improving image-stabilizing performance. One or two or more additives can be contained therein, as needed. The amount of the additive used is usually 0.1 to 15 parts by mass, preferably 0.5 to 10 parts by mass, with respect to 1 part by mass of the color-forming compound.

Hereinafter, the additive of the present invention will be exemplified, but is not limited to these compounds.

(Color-Developing Agent other than Compound Represented by Formula (I))

In the present invention, when at least one compound represented by formula (I) is used in combination with a color-developing agent other than the compound of formula (I), the combination is preferably with a compound represented by formula (IV) and/or a compound represented by formula (V).

(Compound Represented by Formula (IV))

In formula (IV), $R^{81}$ and $R^{82}$ each independently represent a hydroxy group, a halogen atom, a $C_1$-$C_6$ alkyl group, or a $C_2$-$C_6$ alkenyl group. Specifically, examples of the halogen atom and the $C_1$-$C_6$ alkyl group can include the same as the specific examples of $R^1$. Examples of the $C_2$-$C_6$ alkenyl group can include a vinyl group, an allyl group, an isopropenyl group, a 1-propenyl group, a 2-propenyl group, a 1-butenyl group, a 2-butenyl group, a 3-butenyl group, a 1,3-butanedienyl group, and a 2-methyl-2-propenyl group.

$R^9$ represents a hydrogen atom, a $C_1$-$C_6$ alkyl group, or a $C_2$-$C_6$ alkenyl group. Examples of the $C_1$-$C_6$ alkyl group can include the same as the specific examples of $R^1$. Examples of the $C_2$-$C_6$ alkenyl group can include the same as the specific examples of $R^{81}$.

The compound represented by formula (IV) is preferably a diphenylsulfone compound represented by formula (VI).

Examples of the compound represented by formula (IV) can specifically include 4,4'-dihydroxydiphenylsulfone, 2,4'-dihydroxydiphenylsulfone, 4,4'-dihydroxy-3,3'-diallyldiphenylsulfone, 4-hydroxy-4'-methoxydiphenylsulfone, 4-hydroxy-4'-ethoxydiphenylsulfone, 4-hydroxy-4'-n-propoxydiphenylsulfone, 4-hydroxy-4'-isopropoxydiphenylsulfone, 4-hydroxy-4'-n-butoxydiphenylsulfone, 4-hydroxy-4'-sec-butoxydiphenylsulfone, 4-hydroxy-4'-t-butoxydiphenylsulfone, and 4-hydroxy-4'-allyloxydiphenylsulfone.

These compounds of formula (IV) can be used alone or in combination of two or more thereof, as needed, as a color-developing agent. The two or more compounds represented by formula (IV) can be combined at any ratio.

(Compound Represented by Formula (V))

In formula (V), $R^{101}$ to $R^{106}$ atoms each independently represent a halogen atom, a $C_1$-$C_6$ alkyl group, or a $C_2$-$C_6$ alkenyl group; and Y represents a linear or branched, saturated or unsaturated. $C_1$-$C_{12}$ hydrocarbon group optionally having an ether bond or the following formula:

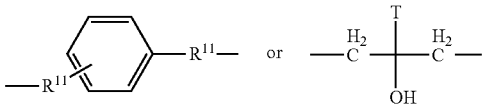

(wherein $R^{11}$ represents a methylene group or an ethylene group, and T represents a hydrogen atom or a $C_1$-$C_4$ alkyl group). Specifically, examples of the halogen atom and the $C_1$-$C_6$ alkyl group can include the same as the specific examples of $R^1$. Examples of the $C_2$-$C_6$ alkenyl group can include the same as the specific examples of $R^{81}$.

Examples of the $C_1$-$C_4$ alkyl group represented by T can include, of those exemplified as the specific examples of $R^1$, groups satisfying the condition of $C_1$-$C_4$.

Examples of Y can include a methylene group, an ethylene group, a trimethylene group, a tetramethylene group, a pentamethylene group, a hexamethylene group, a heptamethylene group, an octamethylene group, a nonamethylene group, a decamethylene group, an undecamethylene group, a dodecamethylene group, a methylmethylene group, a dimethylmethylene group, a methylethylene group, a methyleneethylene group, an ethylethylene group, a 1,2-dimethylethylene group, a 1-methyltrimethylene group, a 1-methyltetramethylene group, a 1,3-dimethyltrimethylene group, a 1-ethyl-4-methyl-tetramethylene group, a vinylene group, a propenylene group, a 2-butenylene group, an ethynylene group, a 2-butynylene group, a 1-vinylethylene group, an ethyleneoxyethylene group, a tetramethyleneoxytetramethylene group, an ethyleneoxyethyleneoxyethylene group, an ethyleneoxymethyleneoxyethylene group, a 1,3-dioxane-5,5-bismethylene group, a 1,2-xylyl group, a 1,3-xylyl group, a 1,4-xylyl group, a 2-hydroxytrimethylene group, a 2-hydroxy-2-methyltrimethylene group, a 2-hydroxy-2-ethyltrimethylene group, a 2-hydroxy-2-propyltrimethylene group, a 2-hydroxy-2-isopropyltrimethylene group, and a 2-hydroxy-2-butyltrimethylene group.

The compound represented by formula (V) is preferably a cross-linked diphenylsulfone compound represented by formula (VII).

Examples of the compound represented by formula (V) can specifically include 4,4'-bis[4-[4-(4-hydroxyphenylsulfonyl)phenoxy]-2-trans-butenyloxy]diphenylsulfone, 4,4'-bis[4-(4-hydroxyphenylsulfonyl)phenoxy-4-butyloxy]diphenylsulfone, 4,4'-bis[4-(4-hydroxyphenylsulfonyl)phenoxy-3-propyloxy]diphenylsulfone, 4,4'-bis[4-(4-hydroxyphenylsulfonyl)phenoxy-2-ethyloxy]diphenylsulfone, 4-[4-(4-hydroxyphenylsulfonyl)phenoxy-4-butyloxy]-4'-[4-(4-hydroxyphenylsulfonyl)phenoxy-3-propyloxy]diphenylsulfone, 4-[4-hydroxyphenylsulfonyl)phenoxy-4-butyloxy]-4'-[4-(4-hydroxyphenylsulfonyl)phenoxy-2-ethyloxy]diphenylsulfone, 4-[4-(4-hydroxyphenylsulfonyl)phenoxy-3-propyloxy]-4'-[4-(4-hydroxyphenylsulfonyl)phenoxy-2-ethyloxy]diphenylsulfone, 4,4'-bis[4-(4-hydroxyphenylsulfonyl)phenoxy-5-pentyloxy]diphenylsulfone, 4,4'-bis[4-(4-hydroxyphenylsulfonyl)phenoxy-6-hexyloxy]diphenylsulfone, 4-[4-[4-(4-hydroxyphenylsulfonyl)phenoxy]-2-trans-butenyloxy]-4'-[4-(4-hydroxyphenylsulfonyl)phenoxy-4-butyloxy]diphenylsulfone, 4-[4-(4-hydroxyphenylsulfonyl)phenoxy-2-trans-butenyloxy]-4'-[4-(4-hydroxyphenylsulfonyl)phenoxy-3-propyloxy]diphenylsulfone, 4-(4-[4-(4-hydroxyphenylsulfonyl)phenoxy]-2-trans-butenyloxy]-4'-[4-(4-hydroxyphenylsulfonyl)phenoxy-2-ethyloxy]diphenylsulfone, 1,4-bis[4-[4-[-(4-hydroxyphenylsulfonyl)phenoxy-2-trans-butenyloxy]phenylsulfonyl]phenoxy]-cis-2-butene, 1,4-bis[4-(4-[4-(4-hydroxyphenylsulfonyl)phenoxy-2-trans-butenyloxy]phenylsulfonyl]phenoxy]-trans-2-butene, 4,4'-bis[4-[4-(2-hydroxyphenylsulfonyl)phenoxy]butyloxy]diphenylsulfone, 4,4'-bis[4-[2-(4-hydroxyphenylsulfonyl)phenoxy]butyloxy]diphenylsulfone, 4,4'-bis[4-(4-hydroxyphenylsulfonyl)phenoxy-2-ethyleneoxyethoxy]diphenylsulfone, 4,4'-bis[4-(4-hydroxyphenylsulfonyl)phenyl-1,4-phenylenebismethyleneoxy]diphenylsulfone, 4,4'-bis[4-(4-hydroxyphenylsulfonyl)phenyl-1,3-phenylenebismethyleneoxy]diphenylsulfone, 4,4'-bis[4-(4-hydroxyphenylsulfonyl)phenyl-1,2-phenylenebismethyleneoxy]diphenylsulfone, 2,2'-bis[4-[4-[4-(4-hydroxyphenylsulfonyl)phenoxy-2-ethyleneoxyethoxy]phenylsulfonyl]phenoxy]diethyl ether, α,α'-bis[4-[4-[4-(4-hydroxyphenylsulfonyl)phenyl-1,4-phenylenebismethyleneoxy]phenylsulfonyl]phenoxy]-p-xylene, α,α'-bis[4-[4-[4-(4-hydroxyphenylsulfonyl)phenyl-1,3-phenylenebismethyleneoxy]phenylsulfonyl]phenoxy]-m-xylene, α,α'-bis[4-[4-[4-(4-hydroxyphenylsulfonyl)phenyl-1,2-phenylenebismethyleneoxy]phenylsulfonyl]phenoxy]-o-xylene, 2,4'-bis[2-(4-hydroxyphenylsulfonyl)phenoxy-2-ethyleneoxyethoxy]diphenylsulfone, 2,4'-bis[4-(2-hydroxyphenylsulfonyl)phenoxy-2-ethyleneoxyethoxy]diphenylsulfone, 4,4'-bis[3,5-dimethyl-4-(3,5-dimethyl-4-hydroxyphenylsulfonyl)phenoxy-2-ethyleneoxyethoxy]diphenylsulfone, 4,4'-bis[3-allyl-4-(3-allyl-4-hydroxyphenylsulfonyl)phenoxy-2-ethyleneoxyethoxy]diphenylsulfone, 4,4'-bis[3,5-dimethyl-4-(3,5-dimethyl-4-hydroxyphenylsulfonyl)phenyl-1,4-phenylenebismethyleneoxy]diphenylsulfone, 4,4'-bis[3,5-dimethyl-4-(3,5-dimethyl-4-hydroxyphenylsulfonyl)phenyl-1,3-phenylenebismethyleneoxy]diphenylsulfone, 4,4'-bis[3,5-dimethyl-4-(3,5-dimethyl-4-hydroxyphenylsulfonyl)phenyl-1,2-phenylenebismethyleneoxy]diphenylsulfone, 4,4'-bis[3-allyl-4-(3-allyl-4-hydroxyphenylsulfonyl)1,4-phenylenebismethyleneoxy]diphenylsulfone, 4,4'-bis[3-allyl-4-(3-allyl-4-hydroxyphenylsulfonyl)1,3-phenylenebismethyleneoxy]diphenylsulfone, 4,4'-bis[3-allyl-4-(3-allyl-4-hydroxyphenylsulfonyl)1,2-phenylenebismethyleneoxy]diphenylsulfone, 4,4'-bis[4-(4-hydroxyphenylsulfonyl)phenoxy-2-hydroxypropyloxy]diphenylsulfone, and 1,3-bis[4-[4-[4-(4-hydroxyphenylsulfonyl)phenoxy-2-hydroxypropyloxy]phenylsulfonyl]phenoxy]-2-hydroxypropane.

These compounds represented by formula (V) can be used alone or in combination of two or more thereof, as needed, as a color-developing agent. The two or more compounds represented by formula (V) can be combined at any ratio. When the two or more compounds represented by formula (V) are combined, the combination of compounds differing in the degree of polymerization (differing in a), which are obtained from the same starting materials, is preferable. In this case, these compounds may be mixed for use, or a mixture comprising some compounds differing in the degree of polymerization can be formed by reaction and used directly as a color-developing agent. Preferable examples thereof can include a product mixture obtained by the reaction between 4,4'-dihydroxydiphenylsulfone and bis(2-chloroethyl)ether. This mixture does not have to contain all compounds wherein a=0 to 10 and may contain products differing in production ratio depending on reaction conditions, etc. Particularly preferably, the mixture is composed mainly of 2,2'-bis[4-(4-hydroxyphenylsulfonyl)phenoxy]diethyl ether, which is a compound wherein a=0, wherein the compound wherein a=0 occupies 5 to 80% by mass, preferably 10 to 60% by mass, particularly preferably 20 to 50% by mass, in the solid content of the mixture.

(Image Stabilizer)

Examples of the image stabilizer used in the present invention can specifically include the followings:

epoxy group-containing diphenylsulfones such as 4-benzyloxy-4'-(2-methylglycidyloxy)-diphenylsulfone and 4,4'-diglycidyloxydiphenylsulfone; and 1,4-diglycidyloxybenzene, 4-[α-(hydroxymethyl)benzyloxy]-4'-hydroxydiphenylsulfone, 2-propanol derivatives, salicylic acid derivatives, metal salts (particularly, zinc salts) of oxynaphthoic acid derivatives, metal salts of 2,2-methylenebis(4,6-t-butylphenyl)phosphate, and other water-insoluble zinc compounds, hindered phenol compounds such as 2,2-bis(4'-hydroxy-3',5'-dibromophenyl)propane, 4,4'-sulfonylbis(2,6-dibromophenol), 4,4'-butylidene(6-t-butyl-3-methylphenol), 2,2'-methylene-bis(4-methyl-6-t-butylphenol), 2,2'-methylene-bis(4-ethyl-6-t-butylphenol), 2,2'-di-t-butyl-5,5'-dimethyl-4,4'-sulfonyldiphenol, 1,1,3'-tris(2-methyl-4-hydroxy-5-cyclohexylphenyl)butane, and 1,1,3-tris(2-methyl-4-hydroxy-5-t-butylphenyl)butane, phenol novolac compounds, and epoxy resins.

The image stabilizer is preferably a compound that is solid at room temperature, particularly preferably has a melting point of 60° C. or higher, and is poorly soluble in water.

Moreover, the image stabilizer is preferably a hindered phenol compound. The hindered phenol compound is not only a compound having a phenol structure having bulky substituents such as t-butyl groups at both ortho positions of the hydroxy group but also may be substituted by at least one $C_1$-$C_6$ alkyl group bonded via secondary or tertiary carbon to the ortho position of the hydroxy group. The alkyl group may be cyclized, as in a cyclohexyl group. Any number of sites having the hindered phenol structure may be present in one molecule.

More preferably, the hindered phenol compound is a compound represented by formula (VIII). In formula (VIII), $R^{13}$ and $R^{14}$ each independently represent a $C_1$-$C_6$ alkyl group. p' and q' each independently represent any integer of 1 to 4, and when p' and q' represents 2 or more, each of $R^{13}$ and $R^{14}$ are the same or different, provided that at least one of $R^{13}$ and $R^{14}$ represents a $C_1$-$C_6$ alkyl group bonded via secondary or tertiary carbon to the ortho position of the hydroxy group. Specifically, examples thereof can include the same as the specific examples of $R^1$. $R^{15}$ represents a hydrogen atom or an optionally substituted $C_1$-$C_6$ alkyl group. Specifically, the optionally substituted $C_1$-$C_6$ alkyl group is the same compound as the specific examples of $R^1$ except that the compound is substituted by at least one selected from a hydroxy group, a halogen atom, a phenyl group, an optionally substituted phenyl group, and a $C_1$-$C_6$ alkoxy group. Furthermore, examples of the halogen atom and the optionally substituted phenyl group can include the same as the specific examples of $R^5$. $R^{15}$ is preferably a compound represented by formula (IX):

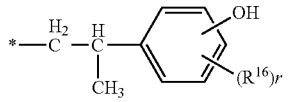

(IX)

[wherein each $R^{16}$ independently represents a $C_1$-$C_6$ alkyl group; r represents 0 or any integer of 1 to 4; and * represents a binding position]. Examples of the $C_1$-$C_6$ alkyl group represented by $R^{16}$ in formula (IX) can specifically include the same as the specific examples of $R^1$.

Examples of the compound typified by formula (VIII) can specifically include 1,1,3-tris(2-methyl-4-hydroxy-5-cyclohexylphenyl)butane, 1,1,3-tris(2-methyl-4-hydroxy-5-t-butylphenyl)butane, 4,4'-butylidene-bis(6-t-butyl-m-cresol), 2,2'-methylene-bis(4-methyl-6-t-butylphenol), and 2,2'-methylene-bis(4-ethyl-6-t-butylphenol).

These image stabilizers can be used alone or in combination of two or more thereof, as needed. The two or more image stabilizers can be combined at any ratio.

(Sensitizer)

Examples of the sensitizer used in the present invention can specifically include the followings:

higher fatty acid amides such as stearic acid amide, stearic acid anilide, and palmitic acid amide;

amides such as benzamide, acetoacetic acid anilide, thioacetanilide acrylic acid amide, ethylenebisamide, ortho-toluenesulfonamide, and para-toluenesulfonamide;

phthalic acid diesters such as dimethyl phthalate, dibenzyl isophthalate, dimethyl isophthalate, dimethyl terephthalate, diethyl isophthalate, diphenyl isophthalate, and dibenzyl terephthalate;

oxalic acid diesters such as dibenzyl oxalate, di(4-methylbenzyl)oxalate, di(4-chlorobenzyl)oxalate, a mixture of benzyl oxalate and di(4-chlorobenzyl)oxalate in equal amounts, and a mixture of di(4-chlorobenzyl)oxalate and di(4-methylbenzyl)oxalate in equal amounts;

bis(t-butylphenols) such as 2,2'-methylenebis(4-methyl-6-t-butylphenol) and 4,4'-methylene-bis-2,6-di-t-butylphenol;

4,4'-dihydroxydiphenylsulfone diethers such as 4,4'-dimethoxydiphenylsulfone, 4,4'-diethoxydiphenylsulfone, 4,4'-dipropoxydiphenylsulfone, 4,4'-diisopropoxydiphenylsulfone, 4,4'-dibutoxydiphenylsulfone, 4,4'-diisobutoxydiphenylsulfone, 4,4'-dipentyloxydiphenylsulfone, 4,4'-dihexyloxydiphenylsulfone, and 4,4'-diallyloxydiphenylsulfone;

2,4'-dihydroxydiphenylsulfone diethers such as 2,4'-dimethoxydiphenylsulfone, 2,4'-diethoxydiphenylsulfone, 2,4'-dipropoxydiphenylsulfone, 2,4'-diisopropoxydiphenylsulfone, 2,4'-dibutoxydiphenylsulfone, 2,4'-diisobutoxydiphenylsulfone, 2,4'-dipentyloxydiphenylsulfone, 2,4'-dihexyloxydiphenylsulfone, and 2,4'-diallyloxydiphenylsulfone;

terphenyls such as m-terphenyl and p-terphenyl;

carbonic acid derivatives such as diphenyl carbonate, guaiacol carbonate, di-p-tolyl carbonate, and phenyl-α-naphthyl carbonate;

1,2-bis(phenoxy)ethane, 1,2-bis(4-methylphenoxy)ethane, 1,2-bis(3-methylphenoxy)ethane, 1,2-bis(phenoxymethyl)benzene, 1,2-bis(4-methoxyphenylthio)ethane, 1,2-bis(4-methoxyphenoxy)propane, 1,3-phenoxy-2-propanol, 1,4-diphenylthio-2-butene, 1,4-diphenylthiobutane, 1,4-diphenoxy-2-butene, 1,5-bis(4-methoxyphenoxy)-3-oxapentane, 1,3-dibenzoyloxypropane, dibenzoyloxymethane, 4,4'-ethylenedioxy-bis-benzoic acid dibenzyl ester, bis[2-(4-methoxy-phenoxy)ethyl]ether, 2-naphthylbenzyl ether, 1,3bis(2-vinyloxyethoxy)benzene, 1,4-diethoxynaphthalene, 1,4-dibenzyloxynaphthalene, 1,4-dimethoxynaphthalene, 1,4-bis(2-vinyloxyethoxy)benzene, p-(2-vinyloxyethoxy)biphenyl, p-aryloxybiphenyl, p-propargyloxybiphenyl, p-benzyloxybenzyl alcohol, 4-(m-methylphenoxymethyl)biphenyl, 4-methylphenyl-biphenyl ether, di-β-naphthylphenylenediamine, diphenylamine, carbazole, 2,3-di-m-tolylbutane, 4-benzylbiphenyl, 4,4'-dimethylbiphenyl, 1,2-bis(3,4-dimethylphenyl)ethane, 2,3,5,6-tetramethyl-4'-methyldiphenylmethane, 4-acetylbiphenyl, dibenzoylmethane, triphenylmethane, phenyl 1-hydroxynaphthoate, methyl 1-hydroxy-2-naphthoate, N-octadecylcarbamoyl-p-methoxycarbonylbenzene, benzyl p-benzyloxybenzoate, phenyl β-naphthoate, methyl p-nitrobenzoate, diphenylsulfone, 1,1-diphenylpropanol, 1,1-diphenylethanol, N-octadecylcarbamoylbenzene, dibenzyl disulfide, stearic acid, Amide AP-1(7:3 mixture of stearic acid amide and palmitic acid amide), and stearates such as aluminum stearate, calcium stearate, and zinc stearate; and zinc palmitate, behenic acid, zinc behenate, montanic acid wax, and polyethylene wax.

Preferable examples thereof can include 2-naphthylbenzyl ether, m-terphenyl, 4-benzylbiphenyl, benzyl oxalate, di(4-chlorobenzyl)oxalate, a mixture of benzyl oxalate and di(4-chlorobenzyl)oxalate in equal amounts, di(4-methylbenzyl) oxalate, a mixture of di(4-chlorobenzyl)oxalate and di(4-methylbenzyl)oxalate in equal amounts, phenyl 1-hydroxy-2-naphthoate, 1,2-bis(phenoxy)ethane, 1,2-bis-(3-methylphenoxy)ethane, 1,2-bis(phenoxymethyl)benzene, dimethyl terephthalate, stearic acid amide, Amide AP-1(7:3 mixture of stearic acid amide and palmitic acid amide), diphenylsulfone, and 4-acetylbiphenyl.

More preferable examples thereof can include di(4-methylbenzyl)oxalate, 1,2-bis(3-methylphenoxy)ethane, 1,2-bis (phenoxymethyl)benzene, diphenylsulfone, and 2-naphthylbenzyl ether.

These sensitizers can be used alone or in combination of two or more thereof, as needed. The two or more stabilizers can be combined at any ratio.

(Other Components in Recording Material)

The recording material of the present invention can contain, in addition to the color-forming compound and the compounds represented by formulas (I), (IV), and (V), one or two or more color-developing agents, sensitizers, image stabilizers, fillers, dispersants, antioxidants, desensitizers, anti-tack agents, antifoaming agents, light stabilizers, fluorescent brightening agents, etc., known in the art, as needed. The amount of each component used is in the range of usually 0.1 to 15 parts by mass, preferably 0.5 to 10 parts by mass, with respect to 1 part by mass of the color-forming compound.

These agents may be contained in a color-developing layer or may be contained in any layer, for example, a protective layer, when they consist of a multilayer structure. Particularly, when an overcoat layer or an undercoat layer is provided in the upper and/or lower parts of the color-developing layer, these layers can contain antioxidants, light stabilizers, etc. Furthermore, these antioxidants or light stabilizers can be contained in a form encapsulated in microcapsules, as needed, in these layers.

Examples of the color-forming compound used in the recording material of the present invention can include, but not limited to, fluoran, phthalide, lactam, triphenylmethane, phenothiazine, and spiropyran leuco dyes. Any color-forming compound that forms a color by contact with the color-developing agent, which is an acidic substance, can be used. Moreover, these color-forming compounds can be used alone to produce a recording material with the color to be formed, as a matter of course. Alternatively, two or more thereof can be mixed for use. For example, three primary color (red, blue, and green)-forming compounds or black color-forming compounds can be mixed and used to produce a recording material that develops a true black color.

Examples of black color-forming compounds include 3-diethylamino-6-methyl-7-anilinofluoran, 3-di(n-butyl)amino-6-methyl-7-anilinofluoran, 3-(N-methyl-N-cyclohexylamino)-6-methyl-7-anilinofluoran, 3-(N-methyl-N-propylamino)-6-methyl-7-anilinofluoran, 3-(N-ethyl-N-isoamylamino)-6-methyl-7-anilinofluoran, 3-(N-ethyl-p-toluidino)-6-methyl-7-anilinofluoran, 3-diethylamino-7-(m-trifluoromethylanilino)fluoran, 3-di(n-pentyl)amino-6-methyl-7-anilinofluoran, 3-(N-ethyl-N-ethoxypropylamino)-6-methyl-7-anilinofluoran, 3-diethylamino-6-methyl-7-n-octylaminofluoran, 3-diethylamino-6-methyl-7-(m-methylanilino)fluoran, 3-diethylamino-6-chloro-7-anilinofluoran, 3-diethylamino-7-(o-chloroanilino)fluoran, 3-dibutylamino-7-(o-chloroanilino) fluoran, 3-(N-ethyl-N-tetrahydrofurfurylamino)-6-methyl-7-anilinofluoran, and 3-dibutylamino-7-(o-fluoroanilino) fluoran.

Examples of blue color-forming compounds include 3,3-bis(p-dimethylaminophenyl)-6-dimethylaminophthalide, 3-(4-diethylamino-2-ethoxyphenyl)-3-(1-ethyl-2-methyl-3-indolyl)-4-azaphthalide, and 3-(4-diethylamino-2-ethoxyphenyl)-3-(1-octyl-2-methyl-3-indolyl)-4-azaphthalide.

Examples of green color-forming compounds include 3-diethylamino-7-dibenzylaminofluoran, 3-(N-ethyl-N-p-tolyl) amino-7-N-methylanilinofluoran, 3,3-bis(4-diethylamino-2-ethoxyphenyl)-4-azaphthalide, and 3,6,6'-tris (dimethylamino)spiro[fluorene-9,3'-phthalide].

Examples of red/orange/yellow color-forming compounds include 3-diethylamino-7-chlorofluoran, 3-diethylamino-benzo[a]fluoran, 3-diethylamino-6-methyl-7-chlorofluoran, 3-cyclohexylamino-6-chlorofluoran, 3-diethylamino-6,8-dimethylfluoran, and 4,4'-isopropylidenedi(4-phenoxy)bis [4-(quinazolin-2-yl)-N,N-diethylaniline].

Moreover, examples of near infrared absorbing dyes include 2-chloro-3-methyl-6-p-(p-phenylaminophenyl)aminoanilinofluoran, 3,3-bis[1-(4-methoxyphenyl)-1-(4-dimethylaminophenyl)ethylen-2-yl]-4,5,6,7-tetrachlorophthalide, and 3,6,6'-tris(dimethylamino)spiro[fluorene-9,3'-phthalide].

Examples of the color-developing agent can include the followings:

BPA color-developing agents, for example, 4,4'-isopropylidenediphenol, 2,2-bis(4-hydroxyphenyl)-4-methylpentane, 4,4'-isopropylidenebis-o-cresol, 4,4'-(1-phenylethylidene) bisphenol, 4,4'-cyclohexylidenebisphenol, 2,2-bis(4-hydroxy-3-phenyl-phenyl)propane, 4,4'-(1,3-phenylenediisopropylidene)bisphenol, 4,4'-(1,4-phenylenediisopropylidene)bisphenol, and butyl bis(p-hydroxyphenyl)acetate.

Examples of phenolic color-developing agents other than those described above include N-(2-hydroxyphenyl)-2-[(4-hydroxyphenyl)thio]acetamide, N-(4-hydroxyphenyl)-2-[(4-hydroxyphenyl)thio]acetamide, a mixture of N-(2-hydroxyphenyl)-2-[(4-hydroxyphenyl)thio]acetamide and N-(4-hydroxyphenyl)-2-[(4-hydroxyphenyl)thio]acetamide in equal amounts, benzyl p-hydroxybenzoate, di(4-hydroxy-3-methylphenyl)sulfide, 4-hydroxybenzenesulfonanilide, 1,5-di(4-hydroxyphenylthio)-3-oxapentane, bis(4-hydroxyphenylthioethoxy)methane, a condensed mixture composed mainly of a binuclear condensate of 2,2'-methylenebis(4-t-butylphenol) described in Japanese unexamined Patent Application Publication No. 2003-154760, and hydroquinone-monobenzyl ether.

Examples of non-phenolic sulfonyl urea color-developing agents include 4,4'-bis(N-p-tolylsulfonylaminocarbonylamino)diphenylmethane and N-p-tolylsulfonyl-N'-3-(p-tolylsulfonyloxy)phenylurea.

Examples of non-phenolic color-developing agents other than those described above include 4,4'-bis[(4-methyl-3-phenoxycarbonylaminophenylureido)], diphenylsulfone, 3-(3-phenylureido)benzenesulfonamide, zinc bis[4-(n-octyloxycarbonylamino)salicylate]dihydrate, zinc 4-[2-(4-methoxyphenoxy)ethoxy]salicylate, and zinc 3,5-bis(α-methylbenzyl)salicylate.

Examples of the filler can include silica, clay, kaolin, fired kaolin, talc, satin white, aluminum hydroxide, calcium carbonate, magnesium carbonate, zinc oxide, titanium oxide, barium sulfate, magnesium silicate, aluminum silicate, plastic pigments, diatomaceous earth, talc, and aluminum hydroxide. Among them, preferable examples thereof can include alkaline earth metal salts, particularly, carbonates such as calcium carbonate and magnesium carbonate. The proportion of the filler used is 0.1 to 15 parts by mass, preferably 1 to 10 parts by mass, with respect to 1 part by mass of the color-forming compound. Moreover, these fillers may be mixed for use.

Examples of the dispersant can include: polyvinyl alcohols having various degrees of saponification and polymerization, such as polyvinyl alcohol, acetoacetylated polyvinyl alcohol, carboxy-modified polyvinyl alcohol, sulfonic acid-modified polyvinyl alcohol, amide-modified polyvinyl alcohol, and butyral-modified vinyl alcohol; cellulose derivatives such as methylcellulose, carboxymethylcellulose, hydroxyethylcellulose, ethylcellulose, acetylcellulose, and hydroxymethylcellulose; and sodium polyacrylate, polyacrylic acid ester, polyacrylamide, starch, sulfosuccinic acid esters such as dioctyl sodium sulfosuccinate, sodium dodecylbenzenesulfonate, a sodium salt of lauryl alcohol sulfonic acid ester, fatty acid salt, styrene-maleic anhydride copolymers, styrene-butadiene copolymers, polyvinyl chloride, polyvinyl acetate, polyacrylic acid ester, polyvinylbutyral, polyurethane, polystyrene and copolymers thereof, polyamide resins, silicone resins, petroleum resins, terpene resins, ketone resins, and coumarone resins.

The dispersant is used after being dissolved in a solvent such as water, alcohol, ketone, ester, or hydrocarbon. Alternatively, the dispersant may be used in a state emulsified in water or other solvents or in the form of paste dispersed therein.

Examples of the antioxidant can include 2,2'-methylenebis(4-methyl-6-t-butylphenol), 2,2'-methylenebis(4-ethyl-6-t-butylphenol), 4,4'-propylmethylenebis(3-methyl-6-t-butylphenol), 4,4'-butylidenebis(3-methyl-6-t-butylphenol), 4,4'-thiobis(2-t-butyl-5-methylphenol), 1,1,3-tris(2-methyl-4-hydroxy-5-t-butylphenyl)butane, 1,1,3-tris(2-methyl-4-hydroxy-5-cyclohexylphenyl)butane, 4-(4-[1,1-bis(4-hydroxyphenyl)ethyl]-α, α-dimethylbenzyl}phenol, 1,1,3-tris(2-methyl-4-hydroxy-5-cyclohexylphenyl)butane, 2,2'-methylenebis(6-tert-butyl-4-methylphenol), 2,2'-methylenebis(6-tert-butyl-4-ethylphenol), 4,4'-thiobis(6-tert-butyl-3-methylphenol), 1,3,5-tris[(4-(1,1-dimethylethyl)-3-hydroxy-2,6-dimethylphenyl}methyl]-1,3,5-triazine-2,4,6(1H,3H,5H)-trione, and 1,3,5-tris[(3,5-bis(1,1-dimethylethyl)-4-hydroxyphenyl)methyl]-1,3,5-triazine-2,4,6(1H,3H,5H)-trione.

Examples of the desensitizer can include aliphatic higher alcohols, polyethylene glycol, and guanidine derivatives.

Examples of the anti-tack agent can include stearic acid, zinc stearate, calcium stearate, carnauba wax, paraffin wax, and ester wax.

Examples of the antifoaming agent can include higher alcohol, fatty acid ester, oil, silicone, polyether, modified hydrocarbon, and paraffin antifoaming agents.

Examples of the light stabilizer can include: salicylic acid UV absorbers such as phenyl salicylate, p-t-butylphenyl salicylate, and p-octylphenyl salicylate; benzophenone UV absorbers such as 2,4-dihydroxybenzophenone, 2-hydroxy-4-methoxybenzophenone, 2-hydroxy-4-benzyloxybenzophenone, 2-hydroxy-4-octyloxybenzophenone, 2-hydroxy-4-dodecyloxybenzophenone, 2,2'-dihydroxy-4-methoxybenzophenone, 2,2'-dihydroxy-4,4'-dimethoxybenzophenone, 2-hydroxy-4-methoxy-5-sulfobenzophenone, and bis(2-methoxy-4-hydroxy-5-benzoylphenyl)methane; benzotriazole UV absorbers such as 2-(2'-hydroxy-5'-methylphenyl)benzotriazole, 2-(2'-hydroxy-5'-t-butylphenyl)benzotriazole, 2-(2'-hydroxy-3',5'-di-t-butylphenyl)benzotriazole, 2-(2'-hydroxy-3'-t-butyl-5'-methylphenyl)-5-chlorobenzotriazole, 2-(2'-hydroxy-3',5'-di-t-butylphenyl)-5-chlorobenzotriazole, 2-(2'-hydroxy-3',5'-di-t-amylphenyl)benzotriazole, 2-(2'-hydroxy-5'-tert-butylphenyl)benzotriazole, 2-(2'-hydroxy-5'-(1",1",3",3"-tetramethylbutyl)phenyl)benzotriazole, 2-[2'-hydroxy-3'-(3",4",5",6"-tetrahydrophthalimidomethyl)-5'-methylphenyl]benzotriazole, 2-(2'-hydroxy-5'-t-octylphenyl)benzotriazole, 2-[2'-hydroxy-3',5'-bis(a,a-dimethylbenzyl)phenyl]-2H-benzotriazole, 2-(2'-hydroxy-3'-dodecyl-5'-methylphenyl)benzotriazole, 2-(2'-hydroxy-3'-undecyl-5'-methylphenyl)benzotriazole, 2-(2'-hydroxy-3'-tridecyl-5'-methylphenyl)benzotriazole, 2-(2'-hydroxy-3'-tetradecyl-5'-methylphenyl)benzotriazole, 2-(2'-hydroxy-3'-pentadecyl-5'-methylphenyl)benzotriazole, 2-(2'-hydroxy-3'-hexadecyl-5'-methylphenyl)benzotriazole, 2-[2'-hydroxy-4'-(2"-ethylhexyl)oxyphenyl]benzotriazole, 2-[2'-hydroxy-4'-(2"-ethylheptyl)oxyphenyl]benzotriazole, 2-[2'-hydroxy-4'-(2"-ethyloctyl)oxyphenyl]benzotriazole, 2-[2'-hydroxy-4'-(2"-propyloctyl)oxyphenyl]benzotriazole, 2-[2'-hydroxy-4'-(2"-propylheptyl)oxyphenyl]benzotriazole, 2-[2'-hydroxy-4'-(2"-propylhexyl)oxyphenyl]benzotriazole, 2-[2'-hydroxy-4'-(1"-ethylhexyl)oxyphenyl]benzotriazole, 2-[2'-hydroxy-4'-(1"-ethylheptyl)oxyphenyl]benzotriazole, 2-[2'-hydroxy-4'-(1'-ethyloctyl)oxyphenyl]benzotriazole, 2-[2'-hydroxy-4'-(1"-propyloctyl)oxyphenyl]benzotriazole, 2-[2'-hydroxy-4'-(1"-propylheptyl)oxyphenyl]benzotriazole, 2-[2'-hydroxy-4'-(1"-propylhexyl)oxyphenyl]benzotriazole, 2,2'-methylenebis[4-(1,1,3,3-tetramethylbutyl)-6-(2H-benzotriazol-2-yl)]phenol, and a condensate of polyethylene glycol and methyl-3-[3-t-butyl-5-(2H-benzotriazol-2-yl)-4-hydroxyphenyl]propionate; cyanoacrylate UV absorbers such as 2'-ethylhexyl-2-cyano-3,3-diphenylacrylate and ethyl-2-cyano-3,3-diphenylacrylate; hindered amine UV absorbers such as bis(2,2,6,6-tetramethyl-4-piperidyl)sebacate, succinic acid-bis(2,2,6,6-tetramethyl-4-piperidyl) ester, and 2-(3,5-di-t-butyl)malonic acid-bis(1,2,2,6,6-pentamethyl-4-piperidyl)ester; and 1,8-dihydroxy-2-acetyl-3-methyl-6-methoxynaphthalene.

Examples of the fluorescent brightening agent can include 4,4'-bis[2-anilino-4-(2-hydroxyethyl)amino-1,3,5-triazinyl-6-amino]stilbene-2,2'-disulfonic acid disodium salt, 4,4'-bis[2-anilino-4-bis(hydroxyethyl)amino-1,3,5-triazinyl-6-amino]stilbene-2,2'-disulfonic acid disodium salt, 4,4'-bis[2-anilino-4-bis(hydroxypropyl)amino-1,3,5-triazinyl-6-amino]stilbene-2,2'-disulfonic acid disodium salt, 4,4'-bis[2-methoxy-4-(2-hydroxyethyl)amino-1,3,5-triazinyl-6-amino]stilbene-2,2'-disulfonic acid disodium salt, 4,4'-bis[2-methoxy-4-(2-hydroxypropyl)amino-1,3,5-triazinyl-6-amino]stilbene-2,2'-disulfonic acid disodium salt, 4,4'-bis[2-m-sulfoanilino-4-bis(hydroxyethyl)amino-1,3,5-triazinyl-6-amino]stilbene-2,2'-disulfonic acid disodium salt, 4-[2-p-sulfoanilino-4-bis(hydroxyethyl)amino-1,3,5-triazinyl-6-amino]-4'-[2-m-sulfoanilino-4-bis(hydroxyethyl)amino-1,3,5-triazinyl-6-amino]stilbene-2,2'-disulfonic acid tetrasodium salt, 4,4'-bis[2-p-sulfoanilino-4-bis(hydroxyethyl)amino-1,3,5-triazinyl-6-amino]stilbene-2,2'-disulfonic acid tetrasodium salt, 4,4'-bis[2-(2,5-disulfoanilino)-4-phenoxyamino-1,3,5-triazinyl-6-amino]stilbene-2,2'-disulfonic acid hexasodium salt, 4,4'-bis[2-(2,5-disulfoanilino)-4-(p-methoxycarbonylphenoxy)amino-1,3,5-triazinyl-6-amino]stilbene-2,2'-disulfonic acid hexasodium salt, 4,4'-bis[2-(p-sulfophenoxy)-4-bis(hydroxyethyl)amino-1,3,5-triazinyl-6-amino]stilbene-2,2'-disulfonic acid hexasodium salt, 4,4'-bis[2-(2,5-disulfoanilino)-4formalinylamino-1,3,5-triazinyl-6-amino]stilbene-2,2'-disulfonic acid hexasodium salt, and 4,4'-bis[2-(2,5-disulfoanilino)-4-bis(hydroxyethyl)amino-1,3,5-triazinyl-6-amino]stilbene-2,2'-disulfonic acid hexasodium salt.

(Method for Producing Recording Material)

When the recording material of the present invention is used in thermal recording paper, it may be used in the same way as a known use method. For example, the thermal recording paper can be produced by separately dispersing fine particles of the compound of the present invention and fine particles of a color-forming compound in aqueous solutions of water-soluble binders such as polyvinyl alcohol or cellulose, mixing these suspension solutions, applying the mixture to a support such as paper, and drying it.

The proportion of the compound represented by formula (I) to the color-forming compound used is usually 0.01 to 10 parts by mass, preferably 0.5 to 10 parts by mass, more preferably 1.0 to 5 parts by mass, with respect to 1 part by mass of the color-forming compound.

The proportion of the color-developing agent other than the compound represented by formula (I) to the color-forming compound used is usually 0.01 to 10 parts by mass, preferably 0.5 to 10 parts by mass, more preferably 1.0 to 5 parts by mass, with respect to 1 part by mass of the color-forming compound.

When the recording material of the present invention is used in pressure-sensitive copying paper, it can be produced in the same way as in use of a known color-developing agent or sensitizer. For example, a color-forming compound microencapsulated by a method known in the art is dispersed in an appropriate dispersant and applied to paper to prepare a sheet of the color-forming compound. Moreover, a dispersion solution of a color-developing agent is applied to paper to prepare a sheet of the color-developing agent. Both the sheets thus prepared are combined to prepare pressure-sensitive copying paper. The pressure-sensitive copying paper may be a unit consisting of: upper paper carrying a microcapsule containing a solution of a color-forming compound in an organic solvent, wherein the microcapsule is applied on the underside of the upper paper; and lower paper carrying a color-developing agent (acidic substance) applied on the top surface of the lower paper. Alternatively, the pressure-sensitive copying paper may be so-called self-contained paper comprising the microcapsule and the color-developing agent applied on the same paper surface.

Those conventionally known are used as the color-developing agent used in the production or the color-developing agent mixed therewith for use. Examples thereof can include: inorganic acidic substances such as Japanese acid clay, activated clay, attapulgite, bentonite, colloidal silica, aluminum silicate, magnesium silicate, zinc silicate, tin silicate, fired kaolin, and talc; aliphatic carboxylic acids such as oxalic acid, maleic acid, tartaric acid, citric acid, succinic acid, and stearic acid; aromatic carboxylic acids such as benzoic acid, p-t-butylbenzoic acid, phthalic acid, gallic acid, salicylic acid, 3-isopropylsalicylic acid, 3-phenylsalicylic acid, 3-cyclohexylsalicylic acid, 3,5-di-t-butylsalicylic acid, 3-methyl-5-benzylsalicylic acid, 3-phenyl-5-(2,2-dimethylbenzyl)salicylic acid, 3,5-di-(2-methylbenzyl)salicylic acid, and 2-hydroxy-1-benzyl-3-naphthoic acid, and metal (e.g., zinc, magnesium, aluminum, and titanium) salts of these aromatic carboxylic acids; phenol resin color-developing agents such as p-phenylphenol-formalin resins and p-butylphenol-acetylene resins, and mixtures of these phenol resin color-developing agents and the metal salts of the aromatic carboxylic acids.

Paper, synthetic paper, a film, a plastic film, a foamed plastic film, nonwoven cloth, recycled paper (e.g., recycled paper pulps), or the like, conventionally known can be used as the support used in the present invention. Moreover, the combination thereof can also be used as the support.

Examples of methods for forming a recording material layer on the support include a method comprising applying a dispersion solution containing a dispersion solution of a color-forming compound, a dispersion solution of a color-developing agent, and a dispersion solution of a filler to a support, followed by drying, a method comprising spraying such a dispersion solution onto a support with a spray or the like, followed by drying, and a method comprising dipping a support in such a dispersion solution for a given time, followed by drying. Moreover, examples of the application method include hand coating, a size press coater method, a roll coater method, an air knife coater method, a blend coater method, a flow coater method, a curtain coater method, a comma direct method, a gravure direct method, a gravure reverse method, and a reverse roll coater method.

EXAMPLES

Hereinafter, a recording material of the present invention will be described in detail with reference to Examples. However, the present invention is not necessarily limited to them.

(Preparation of Thermal Recording Paper)

Example 1

| | (parts: parts by mass) |
|---|---|
| Dispersion solution of color-forming compound (solution A) | |
| 3-di-n-butylamino-6-methyl-7-anilinofluoran | 16 parts |
| 10% aqueous solution of polyvinyl alcohol | 84 parts |
| Dispersion solution of color-developing agent (solution B) | |
| N-(4-hydroxyphenyl)-3-methylcinnamoylamide | 16 parts |
| 10% aqueous solution of polyvinyl alcohol | 84 parts |
| Dispersion solution of color-developing agent 2 (solution C) | |
| 4-hydroxy-4'-isopropoxydiphenylsulfone | 16 parts |
| 10% aqueous solution of polyvinyl alcohol | 84 parts |

-continued

| Dispersion solution of filler (solution D) | |
|---|---|
| Calcium carbonate | 27.8 parts |
| 10% aqueous solution of polyvinyl alcohol | 26.2 parts |
| Water | 71 parts |

First, each mixture having the composition of the solution A, B, C, or D was sufficiently ground with a sand grinder to prepare dispersion solutions of the components of the solutions A to D. 1 part by mass of the solution A, 0.5 part by mass of the solution B, 1.5 parts by mass of the solution C, and 4 parts by mass of the solution D were mixed to prepare a coating solution. This coating solution was applied to white paper using a wire rod (manufactured by Webster, Wire Bar No. 12), and the paper was dried. Then, calendering treatment was performed to prepare thermal recording paper (coating solution: approximately 5.5 g/m$^2$ in terms of dry mass).

Examples 2 to 20

Thermal recording paper was prepared by the method described in Example 1 except that: N-(4-hydroxyphenyl)-3-methylcinnamoylamide described in Example 1 was changed to color-developing agents described in Table A; 4-hydroxy-4'-isopropoxydiphenylsulfone described in Example 1 was changed to additives described in Table A; and the composition of each dispersion solution of Example 1 was changed to part by mass described in Table A.

Comparative Examples 1 to 8

Thermal recording paper was prepared by the method described in Example 1 except that: N-(4-hydroxyphenyl)-3-methylcinnamoylamide described in Example 1 was changed to color-developing agents described in Table A; 4-hydroxy-4'-isopropoxydiphenylsulfone described in Example 1 was changed to additives described in Table A; and the composition of each dispersion solution of Example 1 was changed to part by mass described in Table A.

TABLE A

| | A Solution | B Solution | C Solution | D Solution | Color-developing agent | Effect brought about by addition | Additive |
|---|---|---|---|---|---|---|---|
| | Part by mass | | | | | | |
| Example 1 | 1 | 0.5 | 1.5 | 4 | N-(4-hydroxyphenyl)-3-methylcinnamoylamide | Color-developing agent | 4-hydroxy-4'-isopropoxydiphenylsulfone |
| Example 2 | 1 | 1.0 | 1.0 | 4 | N-(4-hydroxyphenyl)-3-methylcinnamoylamide | Color-developing agent | 4-hydroxy-4'-isopropoxydiphenylsulfone |
| Example 3 | 1 | 1.5 | 0.5 | 4 | N-(4-hydroxyphenyl)-3-methylcinnamoylamide | Color-developing agent | 4-hydroxy-4'-isopropoxydiphenylsulfone |
| Example 4 | 1 | 0.5 | 1.5 | 4 | N-(4-hydroxyphenyl)-3-methylcinnamoylamide | Color-developing agent | D-90(Color-developing agent for thermal recording paper manufactured by Nippon Soda Co., Ltd.) |
| Example 5 | 1 | 1.0 | 1.0 | 4 | N-(4-hydroxyphenyl)-3-methylcinnamoylamide | Color-developing agent | D-90(Color-developing agent for thermal recording paper manufactured by Nippon Soda Co., Ltd.) |
| Example 6 | 1 | 1.5 | 0.5 | 4 | N-(4-hydroxyphenyl)-3-methylcinnamoylamide | Color-developing agent | D-90(Color-developing agent for thermal recording paper manufactured by Nippon Soda Co., Ltd.) |
| Comparative Example 1 | 1 | 2.0 | — | 4 | N-(4-hydroxyphenyl)-3-methylcinnamoylamide | | Absent |
| Comparative Example 2 | 1 | — | 2.0 | 4 | N-(4-hydroxyphenyl)-3-methylcinnamoylamide | Color-developing agent | 4-hydroxy-4'-isopropoxydiphenylsulfone |
| Comparative Example 3 | 1 | — | 2.0 | 4 | N-(4-hydroxyphenyl)-3-methylcinnamoylamide | Color-developing agent | D-90(Color-developing agent for thermal recording paper manufactured by Nippon Soda Co., Ltd.) |
| Example 7 | 1 | 2 | 1 | 4 | N-(3-hydroxyphenyl)-3-methylcinnamoylamide | Image stabilizer | 1,1,3-tris(2-methyl-4-hydroxy-5-cyclohexylphenyl)butane |
| Example 8 | 1 | 2 | 1 | 4 | N-(3-hydroxyphenyl)-3-methylcinnamoylamide | Image stabilizer | 1,1,3-tris(2-methyl-4-hydroxy-5-t-butylphenyl)butane |
| Example 9 | 1 | 2 | 1 | 4 | N-(4-hydroxyphenyl)-3-methylcinnamoylamide | Image stabilizer | 1,1,3-tris(2-methyl-4-hydroxy-5-cyclohexylphenyl)butane |
| Example 10 | 1 | 2 | 1 | 4 | N-(4-hydroxyphenyl)-2,3-dimethoxycinnamoylamide | Image stabilizer | 1,1,3-tris(2-methyl-4-hydroxy-5-cyclohexylphenyl)butane |
| Comparative Example 4 | 1 | 2 | — | 4 | N-(3-hydroxyphenyl)-3-methylcinnamoylamide | | Absent |
| Comparative Example 5 | 1 | 2 | — | 4 | N-(4-hydroxyphenyl)-3-methylcinnamoylamide | | Absent |
| Comparative Example 6 | 1 | 2 | — | 4 | N-(4-hydroxyphenyl)-2,3-dimethoxycinnamoylamide | | Absent |
| Example 11 | 1 | 2 | 1 | 4 | N-(4-hydroxyphenyl)-3-methylcinnamoylamide | Sensitizer | Di(4-methylbenzyl) oxalate |
| Example 12 | 1 | 2 | 1 | 4 | N-(4-hydroxyphenyl)-3-methylcinnamoylamide | Sensitizer | 1,2-bis(3-methylphenoxy)ethane |
| Example 13 | 1 | 2 | 1 | 4 | N-(4-hydroxyphenyl)-3-methylcinnamoylamide | Sensitizer | 1,2-bis(phenoxymethyl)benzene |

TABLE A-continued

| | A Solution | B Solution | C Solution | D Solution | Color-developing agent | Effect brought about by addition | Additive |
|---|---|---|---|---|---|---|---|
| | Part by mass | | | | | | |
| Example 14 | 1 | 2 | 1 | 4 | N-(4-hydroxyphenyl)-3-methylcinnamoylamide | Sensitizer | Diphenylsulfone |
| Example. 15 | 1 | 2 | 1 | 1 | N-(4-hydroxyphenyl)-3-methylcinnamoylamide | Sensitizer | 2-naphthylbenzyl ether |
| Example 16 | 1 | 2 | 1 | 4 | N-(4-hydroxyphenyl)-2,3-dimethoxycinnamoylamide | Sensitizer | Di(4-methylbenzyl) oxalate |
| Example 17 | 1 | 2 | 1 | 4 | N-(4-hydroxyphenyl)-2,3-dimethoxycinnamoylamide | Sensitizer | 1,2-bis(3-methylphenoxy)ethane |
| Example 18 | 1 | 2 | 1 | 4 | N-(4-hydroxyphenyl)-2,3-dimethoxycinnamoylamide | Sensitizer | 1,2-bis(phenoxymethyl)benzene |
| Example 19 | 1 | 2 | 1 | 4 | N-(4-hydroxyphenyl)-2,3-dimethoxycinnamoylamide | Sensitizer | Diphenylsulfone |
| Example 20 | 1 | 2 | 1 | 4 | N-(4-hydroxyphenyl)-2,3-dimethoxycinnamoylamide | Sensitizer | 2-naphthylbenzyl ether |
| Comparative Example 7 | 1 | 2 | — | 4 | N-(4-hydroxyphenyl)-3-methylcinnamoylamide | | Absent |
| Comparative Example 8 | 1 | 2 | — | 4 | N-(4-hydroxyphenyl)-2,3-dimethoxycinnamoylamide | | Absent |

Test Example 1

Evaluation on Moist Heat Resistance of Background

Each test paper of Examples 1 to 6 and Comparative Examples 1 to 3 was subjected to a stability test under conditions shown below. Evaluation determined based on the results is summarized in Table 2.

Before Test

A portion of each thermal recording paper prepared in Examples 1 to 6 and Comparative Examples 1 to 3 was cut off, and the optical concentration of the background was measured using a Macbeth reflection densitometer (filter used: #106).

Moist Heat Resistance Test

A portion of each thermal recording paper prepared in Examples 1 to 6 and Comparative Examples 1 to 3 was cut off and kept in a low-temperature thermohygrostat (trade name: THN050FA, manufactured by ADVANTEC Toyo Kaisha, Ltd.) under conditions involving 50° C. and 80% humidity for hours. The optical concentration of the background after being kept was measured using a Macbeth reflection densitometer (filter used: #106).

Test Example 2

Evaluation on Light Resistance of Background

Each test paper of Examples 1 to 6 and Comparative Examples 1 to 3 was subjected to a stability test under conditions shown below. Evaluation determined based on the results is summarized in Table 2.

Before Test

A portion of each thermal recording paper prepared in Examples 1 to 6 and Comparative Examples 1 to 3 was cut off, and the optical concentration of the background was measured using a Macbeth reflection densitometer (filter used: #106).

Light Resistance Test of Background

A portion of each thermal recording paper prepared in Examples 1 to 6 and Comparative Examples 1 to 3 was cut off and subjected to a light resistance test using a light resistance tester (trade name: UV Long-Life Fade Meter model U48, manufactured by Suga Test Instruments Co., Ltd.). After 8 hours, the optical concentration of the background was measured using a Macbeth reflection densitometer (filter used: #47).

Test Example 3

Heat Resistance of Image

Each test paper of Examples 1 to 6 and Comparative Examples 1 to 3 was subjected to a stability test under conditions shown below. Evaluation determined based on the results is summarized in Table 2.

Before Test

A portion of each thermal recording paper prepared in Examples 1 to 6 and Comparative Examples 1 to 3 was cut off and colored under conditions involving a printing voltage of 17 V and a pulse width of 1.8 ms using a thermal printing tester (trade name: model TH-PMH, manufactured by Ohkura Electric Co., Ltd.). The concentration of the colored image was measured using a Macbeth reflection densitometer (filter used: #106).

Test on Heat Resistance of Image

The colored image was subjected to a heat resistance test in a thermostat (trade name: DK-400, manufactured by Yamato Scientific Co., Ltd) at a temperature of 100° C. After 24 hours, the concentration of the colored image was measured using a Macbeth reflection densitometer (filter used: #106).

TABLE 2

| | Evaluation test | | |
|---|---|---|---|
| | Moist heat resistance of background | Light resistance of background | Heat resistance of image |
| Example 1 | ⊙ | ○ | ⊙ |
| Example 2 | ⊙ | ⊙ | ⊙ |
| Example 3 | ⊙ | ⊙ | ○ |
| Example 4 | ⊙ | ○ | ⊙ |
| Example 5 | ⊙ | ⊙ | ⊙ |
| Example 6 | ⊙ | ⊙ | ○ |
| Comparative Example 1 | ⊙ | ⊙ | Δ |
| Comparative Example 2 | ⊙ | Δ | ⊙ |

TABLE 2-continued

| | Evaluation test | | |
|---|---|---|---|
| | Moist heat resistance of background | Light resistance of background | Heat resistance of image |
| Comparative Example 3 | ⊙ | Δ | ⊙ |

⊙: Practically no problem
○: Slightly poor, but practically no problem
Δ: Practically impossible to use As is evident from the results of Table 2, the recording material of the present invention was hardly adversely affected by the combined use of color-developing agents and was excellent in the light resistance and moist heat resistance of the background and the heat resistance of colored images.

Test Example 4

Evaluation on Moist Heat Resistance/Heat Resistance of Background

Each test paper of Examples 7 to 10 and Comparative Examples 4 to 6 was subjected to a stability test under conditions shown below. The results are summarized in Table 3.

Before Test

A portion of each thermal recording paper prepared in Examples 7 to 10 and Comparative Examples 4 to 6 was cut off, and the optical concentration of the background was measured using a Macbeth reflection densitometer (filter used: #106).

Moist Heat Resistance Test

A portion of each thermal recording paper prepared in Examples 7 to 10 and Comparative Examples 4 to 6 was cut off and kept in a low-temperature thermohygrostat (trade name: THN050FA, manufactured by ADVANTEC Toyo Kaisha, Ltd.) under conditions involving 50° C. and 80% humidity for 24 hours. The optical concentration of the background after being kept was measured using a Macbeth reflection densitometer (filter used: #106).

Heat Resistance Test

A portion of each thermal recording paper prepared in Examples 7 to 10 and Comparative Examples 4 to 6 was cut off and kept in a thermostat (trade name: DK-400, manufactured by Yamato Scientific Co., Ltd) at respective temperatures of 100° C. and 110° C. for 24 hours. The optical concentration of the background after being kept was measured using a Macbeth reflection densitometer (filter used: #106).

TABLE 3

Evaluation results of moist heat resistance/heat resistance of background

| | Before test | Moist heat resistance test 24 hours | Heat resistance test 100° C. | Heat resistance test 110° C. |
|---|---|---|---|---|
| Example 7 | 0.05 | 0.05 | 0.06 | 0.08 |
| Example 8 | 0.06 | 0.06 | 0.06 | 0.07 |
| Example 9 | 0.07 | 0.08 | 0.06 | 0.09 |
| Example 10 | 0.08 | 0.08 | 0.05 | 0.07 |
| Comparative Example 4 | 0.04 | 0.04 | 0.05 | 0.05 |
| Comparative Example 5 | 0.07 | 0.06 | 0.08 | 0.10 |

TABLE 3-continued

Evaluation results of moist heat resistance/heat resistance of background

| | Before test | Moist heat resistance test 24 hours | Heat resistance test 100° C. | Heat resistance test 110° C. |
|---|---|---|---|---|
| Comparative Example 6 | 0.07 | 0.07 | 0.10 | 0.11 |

As is evident from the results of Table 3, the comparisons between Examples 7 to 8 and Comparative Example 4, between Example 9 and Comparative Example 3, and between Example 10 and Comparative Example 6 showed that the recording material of the present invention had exceedingly good moist heat resistance and heat resistance of the background and was hardly altered even by the addition of the image stabilizer, compared with the image stabilizer-free samples. Thus, the recording material was almost free from usually expected adverse effect caused by the addition and particularly produced exceedingly favorable results even in the heat resistance test conducted at 110° C.

Test Example 5

Light Resistance of Background

Each test paper of Examples 7 to 10 and Comparative Examples 4 to 6 was subjected to a stability test under conditions shown below. The results are summarized in Table 4.

Before Test.

A portion of each thermal recording paper prepared in Examples 7 to 10 and Comparative Examples 4 to 6 was cut off, and the optical concentration of the background was measured using a Macbeth reflection densitometer (filter used: #106).

Light Resistance of Background

A portion of each thermal recording paper prepared in Examples 7 to 10 and Comparative Examples 4 to 6 was cut off and subjected to a light resistance test using a light resistance tester (trade name: UV Long-Life Fade Meter model U48, manufactured by Suga Test Instruments Co., Ltd.). After 12 hours and 24 hours, the concentration of the background was measured using a Macbeth reflection densitometer (filter used: #47).

TABLE 4

Evaluation results of light resistance of background.

| | Before test | Test on light resistance of background 12 hours | Test on light resistance of background 24 hours |
|---|---|---|---|
| Example 7 | 0.06 | 0.19 | 0.25 |
| Example 8 | 0.07 | 0.19 | 0.24 |
| Example 9 | 0.13 | 0.17 | 0.24 |
| Example 10 | 0.15 | 0.19 | 0.23 |
| Comparative Example 4 | 0.06 | 0.17 | 0.21 |
| Comparative Example 5 | 0.12 | 0.17 | 0.22 |
| Comparative Example 6 | 0.14 | 0.17 | 0.22 |

As is evident from the results of Table 4, the comparisons between Examples 7 to 8 and Comparative Example 4, between Example 9 and Comparative Example 5, and between Example 10 and Comparative Example 6 showed that the recording material of the present invention had exceedingly good light resistance of the background and was hardly altered even by the addition of the image stabilizer, compared with the image stabilizer-free samples. Thus, the recording material was almost free from usually expected adverse effect caused by the addition.

Test Example 6

Heat Resistance of Image

Each test paper of Examples 7 to 10 and Comparative Examples 4 to 6 was subjected to a stability test under conditions shown below. The results are summarized in Table 5.

A portion of each thermal recording paper prepared in Examples 7 to 10 and Comparative Examples 4 to 6 was cut off and colored under conditions involving a printing voltage of 17 V and a pulse width of 1.8 ms using a thermal printing tester (trade name: model TH-PMH, manufactured by Ohkura Electric Co., Ltd.). The concentration of the colored image was measured using a Macbeth reflection densitometer (filter used: #106). The colored image was subjected to a heat resistance test in a thermostat (trade name: DK-400, manufactured by Yamato Scientific Co., Ltd) at a temperature of 100° C. After 24 hours, the concentration of the colored image was measured using a Macbeth reflection densitometer (filter used: #106).

As is evident from the results of Table 5, the comparisons between Examples 7 to 8 and Comparative Example 4, between Example 9 and Comparative Example 5, and between Example 10 and Comparative Example 6 showed that the heat resistance of the image was significantly improved in Examples 7 to 10.

TABLE 5

| Heat resistance of image | | | | |
|---|---|---|---|---|
| | Before test | | Image stabilizer | |
| | Added | Not added | Added | Not added |
| Example 7 | 1.16 | 1.10 | 1.07 | 0.15 |
| Example 8 | 1.22 | (Comparative Example 4) | 1.09 | (Comparative Example 4) |
| Example 9 | 1.27 | 1.25 (Comparative Example 5) | 1.17 | 0.34 (Comparative Example 5) |
| Example 10 | 1.25 | 1.23 (Comparative Example 6) | 1.19 | 0.30 (Comparative Example 6) |

Test Example 7

(Dynamic Color Developing Sensitivity)

A portion of each recording paper prepared in Examples 11 to 20 and Comparative Examples 7 to 8 was cut off and subjected to a dynamic color-developing sensitivity test using a thermal printing tester (trade name: model TH-PMH, manufactured by Ohkura Electric Co., Ltd.). The portion was colored under conditions involving a printing voltage of 17 V and respective pulse widths of 0.2, 0.35, 0.5, 0.65, 0.8, 0.95, 1.1, 1.25, 1.4, 1.6, and 1.8 ms. Then, the concentration of the print was measured using a Macbeth reflection densitometer (filter used: #106).

Figure 2:
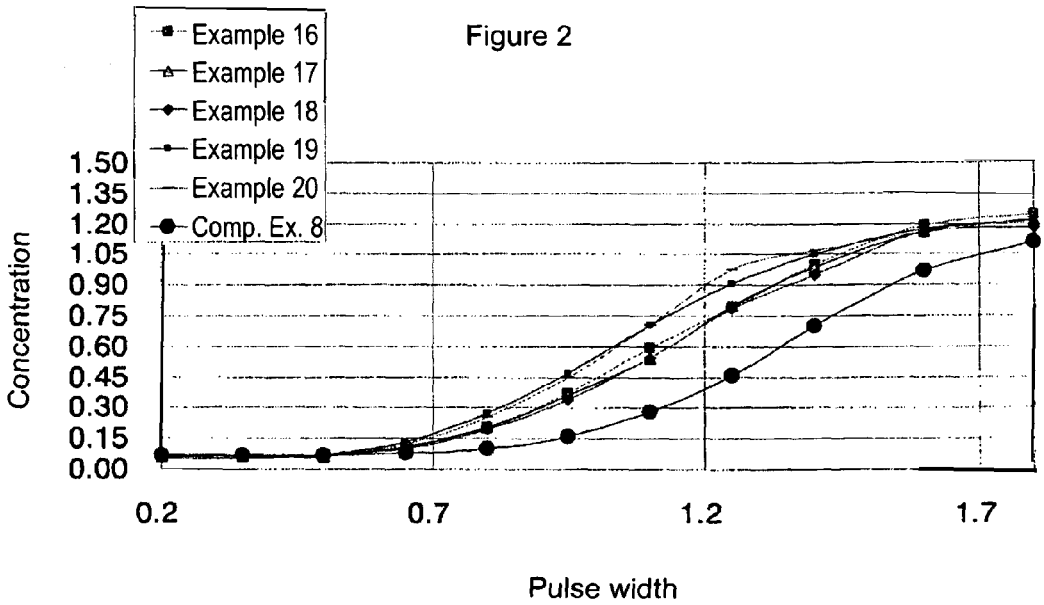
FIG. 2 is a diagram showing results of a dynamic color-developing sensitivity test using each recording paper prepared in Examples 16 to 20 and Comparative Example 8.

The results are summarized in FIGS. 1 to 2. Moreover, the values of the samples colored under the conditions of 1.1 and 1.25 ms are described as typical values in Tables 6 and 7.

TABLE 6

| Dynamic color-developing sensitivity | | |
|---|---|---|
| | Pulse width | |
| | 1.1 ms | 1.25 ms |
| Example 11 | 0.61 | 0.85 |
| Example 12 | 0.61 | 0.88 |
| Example 13 | 0.59 | 0.81 |
| Example 14 | 0.68 | 0.88 |
| Example 15 | 0.66 | 0.92 |
| Comparative Example 7 | 0.41 | 0.61 |

TABLE 7

| Dynamic color-developing sensitivity | | |
|---|---|---|
| | Pulse width | |
| | 1.1 ms | 1.25 ms |
| Example 16 | 0.60 | 0.79 |
| Example 17 | 0.55 | 0.80 |
| Example 18 | 0.55 | 0.79 |
| Example 19 | 0.71 | 0.91 |
| Example 20 | 0.71 | 0.98 |
| Comparative Example 8 | 0.46 | 0.62 |

As is evident from the results of FIGS. 1 to 2 and Tables 6 to 7, the comparisons between Examples 11 to 15 and Comparative Example 7 and between Examples 16 to 20 and Comparative Example 8 showed that the dynamic color-developing sensitivity was improved in Examples 11 to 20.

Test Example 8

(Evaluation on Moist Heat Resistance/Heat Resistance of Background)

Each test paper of Examples 11 to 20 and Comparative Examples 7 to 8 was subjected to a stability test under conditions shown below. The results are summarized in Tables 8 and 9.

Before Test

A portion of each thermal recording paper prepared in Examples 11 to 20 and Comparative Examples 7 to 8 was cut off, and the optical concentration of the background was measured using a Macbeth reflection densitometer (filter used: #106).

Moist Heat Resistance Test

A portion of each thermal recording paper prepared in Examples 11 to 20 and Comparative Examples 7 to 8 was cut off and kept in a low-temperature thermohygrostat (trade name: THN050FA, manufactured by ADVANTEC Toyo Kaisha, Ltd.) under conditions involving 50° C. and 80% humidity for 24 hours. The optical concentration of the background after being kept was measured using a Macbeth reflection densitometer (filter used: #106).

Heat Resistance Test

A portion of each thermal recording paper prepared in Examples 11 to 20 and Comparative Examples 7 to 8 was cut off and kept in a thermostat (trade name: DK-400, manufactured by Yamato Scientific Co., Ltd) at respective temperatures of 100° C. and 120° C. for 24 hours. The optical concentration of the background after being kept was measured using a Macbeth reflection densitometer (filter used: #106).

TABLE 8

Evaluation results of heat resistance of background

| | Before test | Moist heat resistance 24 hours | Heat resistance 100° C. | Heat resistance 120° C. |
|---|---|---|---|---|
| Example 11 | 0.07 | 0.06 | 0.08 | 0.13 |
| Example 12 | 0.07 | 0.07 | 0.07 | 0.11 |
| Example 13 | 0.07 | 0.06 | 0.08 | 0.12 |
| Example 14 | 0.06 | 0.06 | 0.07 | 0.13 |
| Example 15 | 0.05 | 0.07 | 0.08 | 0.11 |
| Comparative Example 7 | 0.07 | 0.07 | 0.05 | 0.08 |

TABLE 9

Evaluation results of heat resistance of background

| | Before test | Moist heat resistance 24 hours | Heat resistance 100° C. | Heat resistance 120° C. |
|---|---|---|---|---|
| Example 16 | 0.07 | 0.06 | 0.07 | 0.11 |
| Example 17 | 0.06 | 0.07 | 0.06 | 0.09 |
| Example 18 | 0.07 | 0.06 | 0.07 | 0.11 |
| Example 19 | 0.06 | 0.06 | 0.07 | 0.12 |
| Example 20 | 0.06 | 0.06 | 0.08 | 0.12 |
| Comparative Example 8 | 0.07 | 0.07 | 0.06 | 0.08 |

As is evident from the results of Tables 8 and 9, the comparisons between Examples 11 to 15 and Comparative Example 7 and between Examples 16 to 20 and Comparative Example 8 showed that the recording material of the present invention had exceedingly good moist heat resistance and heat resistance of the background and was hardly altered even by the addition of the sensitizer, compared with the sensitizer-free samples. Thus, the recording material was almost free from usually expected adverse effect caused by the addition and particularly produced exceedingly favorable results even in the heat resistance test conducted at 120° C.

Test Example 9

(Light Resistance of Background)

Each test paper of Examples 11 to 20 and Comparative Examples 7 to 8 was subjected to a stability test under conditions shown below. The results are summarized in Tables 10 and 11.

Before Test

A portion of each thermal recording. paper prepared in Examples 11 to 20 and Comparative Examples 7 to 8 was cut off, and the optical concentration of the background was measured using a Macbeth reflection densitometer (filter used: #106).

Light Resistance of Background

A portion of each thermal recording paper prepared in Examples 11 to 20 and Comparative Examples 7 to 8 was cut off and subjected to a light resistance test using a light resistance tester (trade name: UV Long-Life Fade Meter model U48, manufactured by Suga Test Instruments Co., Ltd.). After 12 hours and 24 hours, the concentration of the background was measured using a Macbeth reflection densitometer (filter used: #106 and #47).

TABLE 10

Evaluation results of light resistance of background

| | Before test | Light resistance of background 12 hours (B) | 24 hours (B) | 12 hours (Y) | 24 hours (Y) |
|---|---|---|---|---|---|
| Example 11 | 0.07 | 0.07 | 0.10 | 0.16 | 0.23 |
| Example 12 | 0.07 | 0.07 | 0.10 | 0.15 | 0.23 |
| Example 13 | 0.07 | 0.07 | 0.10 | 0.16 | 0.22 |
| Example 14 | 0.06 | 0.08 | 0.10 | 0.17 | 0.20 |
| Example 15 | 0.05 | 0.08 | 0.10 | 0.16 | 0.21 |
| Comparative Example 7 | 0.07 | 0.08 | 0.11 | 0.17 | 0.22 |

(In the table, B represents Macbeth filter Wratten No. 106 and Y represents Macbeth filter Wratten No. 47.)

TABLE 11

Evaluation results of light resistance of background

| | Before test | Light resistance of background 12 hours (B) | 24 hours (B) | 12 hours (Y) | 24 hours (Y) |
|---|---|---|---|---|---|
| Example 16 | 0.07 | 0.08 | 0.10 | 0.17 | 0.22 |
| Example 17 | 0.06 | 0.07 | 0.09 | 0.17 | 0.21 |
| Example 18 | 0.07 | 0.07 | 0.10 | 0.18 | 0.22 |
| Example 19 | 0.06 | 0.08 | 0.10 | 0.17 | 0.20 |
| Example 20 | 0.06 | 0.08 | 0.10 | 0.16 | 0.21 |
| Comparative Example 8 | 0.07 | 0.08 | 0.11 | 0.17 | 0.22 |

(In the table, B represents Macbeth filter Wratten No. 106 and Y represents Macbeth filter Wratten No. 47.)

As is evident from the results of Tables 10 and 11, the comparisons between Examples 11 to 15 and Comparative Example 7 and between Examples 16 to 20 and Comparative Example 8 showed that the recording material of the present invention had exceedingly good light resistance of the background and was hardly altered even by the addition of the sensitizer, compared with the sensitizer-free samples. Thus, the recording material was almost free from usually expected adverse effect caused by the addition.

Example 21

(Sensitizer Formulation: Preparation of Thermal Recording Paper)

| | |
|---|---|
| Dispersion solution of color-forming compound (solution A) | |
| 3-di-n-butylamino-6-methyl-7-anilinofluoran | 16 parts |
| 10% aqueous solution of polyvinyl alcohol | 84 parts |
| Dispersion solution of color-developing agent (solution B) | |
| N-(2-hydroxyphenyl)-cinnamoylamide | 16 parts |
| 10% aqueous solution of polyvinyl alcohol | 84 parts |
| Dispersion solution of filler (solution C) | |
| Calcium carbonate | 27.8 parts |
| 10% aqueous solution of polyvinyl alcohol | 26.2 parts |
| Water | 71 parts |
| Dispersion solution of sensitizer (solution D) | |
| Di (4-methylbenzyl) oxalate | 16 parts |
| 10% aqueous solution of polyvinyl alcohol | 84 parts |

First, each mixture having the composition of the solution A, B, C, or D was sufficiently ground with a sand grinder to prepare dispersion solutions of the components of the solutions A to D. 1 part by mass of the solution A, 2 parts by mass of the solution B, 4 parts by mass of the solution C, and 1 part by mass of the solution D were mixed to prepare a coating solution. This coating solution was applied to white paper using a wire rod (manufactured by Webster, Wire Bar No. 12), and the paper was dried: Then, calendering treatment was performed to prepare thermal recording paper (coating solution: approximately 5.5 g/m$^2$ in terms of dry mass).

Example 22

Thermal recording paper was prepared by the method described in Example 21 except that 1,2-bis(3-methylphenoxy)ethane was used instead of di(4-methylbenzyl)oxalate in the dispersion solution of the sensitizer (solution D) of Example 21.

Comparative Example 9

Thermal recording paper was prepared by the method described in Example 21 except that of the dispersion solutions prepared in Example 21, 1 part by mass of the solution A, 2 parts by mass of the solution B, and 4 parts by mass of the solution C were mixed to prepare a coating solution.

Test Example 10

(Dynamic Color-Developing Sensitivity)

TABLE 12

| | Pulse width | |
|---|---|---|
| | 1.1 ms | 1.25 ms |
| Example 21 | 1.11 | 1.24 |
| Example 22 | 1.16 | 1.27 |
| Comparative Example 9 | 0.91 | 1.11 |

Figure 3:
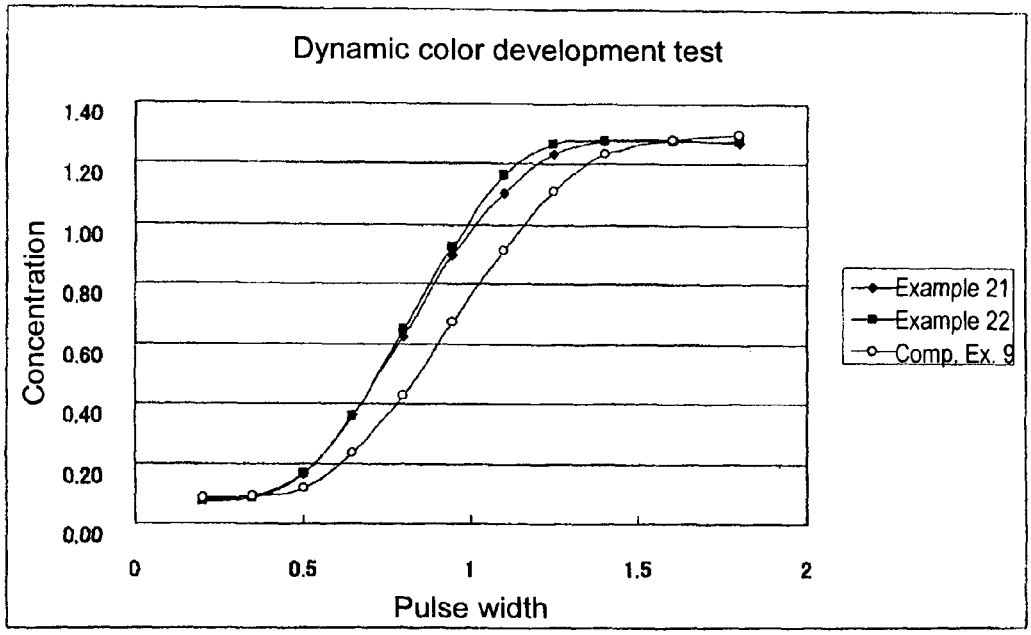
FIG. 3 is a diagram showing results of a dynamic color-developing sensitivity test using each recording paper prepared in. Examples 21 and 22 and Comparative Example 9.

Thermal printing tester (trade name: model TH-PMH, manufactured by Ohkura Electric Co., Ltd.)
Printing voltage: 17 V, Pulse width: 0.2, 0.35, 0.5, 0.65, 0.8, 0.95, 1.1, 1.25, 1.4, 1.6, 1.8 ms As is evident from Table 12 and FIG. 3, the comparison between Examples 21 to 22 and Comparative Example 9 showed that the dynamic color-developing sensitivity was improved in Examples 21 to 22.

Test Example 11

(Light Resistance of Background)

TABLE 13

| | | Light resistance of background | | | |
|---|---|---|---|---|---|
| | Before test | 6 hours (B) | 12 hours (B) | 6 hours (Y) | 12 hours (Y) |
| Example 21 | 0.07 | 0.10 | 0.12 | 0.17 | 0.24 |
| Example 22 | 0.07 | 0.09 | 0.13 | 0.16 | 0.25 |
| Comparative Example 9 | 0.07 | 0.08 | 0.13 | 0.15 | 0.26 |

Light resistance tester (trade name: UV Long-Life Fade Meter model U48, manufactured by Suga Test Instruments Co., Ltd.)

As is evident from the results of Table 13, the comparison between Examples 21 to 22 and Comparative Example 9 showed that the recording material of the present invention had exceedingly good light resistance of the background and was hardly altered even by the addition of the sensitizer, compared with the sensitizer-free samples. Thus, the recording material was almost free from usually expected adverse effect caused by the addition.

Example 23

(Image Stabilizer Formulation; Preparation of Thermal Recording Paper)

| | |
|---|---|
| Dispersion solution of color-forming compound (solution A) | |
| 3-di-n-butylamino-6-methyl-7-anilinofluoran | 16 parts |
| 10% aqueous solution of polyvinyl alcohol | 84 parts |
| Dispersion solution of color-developing agent (solution B) | |
| N-(2-hydroxyphenyl)-cinnamoylamide | 16 parts |
| 10% aqueous solution of polyvinyl alcohol | 84 parts |
| Dispersion solution of filler (solution C) | |
| Calcium carbonate | 27.8 parts |
| 10% aqueous solution of polyvinyl alcohol | 26.2 parts |
| Water | 71 parts |
| Dispersion solution of image stabilizer (solution D) | |
| 1,1,3-tris(2-methyl-4-hydroxy-5-cyclohexylphenyl)butane | 16 parts |
| 10% aqueous solution of polyvinyl alcohol | 84 parts |

First, each mixture having the composition of the solution A, B, C, or D was sufficiently ground with a sand grinder to prepare dispersion solutions of the components of the solutions A to D. 1 part by mass of the solution A, 2 parts by mass of the solution B, 4 parts by mass of the solution C, and 1 part by mass of the solution D were mixed to prepare a coating solution. This coating solution was applied to white paper using a wire rod (manufactured by Webster, Wire Bar No. 12), and the paper was dried. Then, calendering treatment was performed to prepare thermal recording paper (coating solution: approximately 5.5 g/m$^2$ in terms of dry mass).

Example 24

Thermal recording paper was prepared by the method described in Example 23 except that 1,1,3-tris(2-methyl-4-hydroxy-5-t-butylphenyl)butane was used instead of 1,1,3-tris(2-methyl-4-hydroxy-5-cyclohexylphenyl)butane in the dispersion solution of the sensitizer (solution D) of Example 23.

Comparative Example 10

Thermal recording paper was prepared by the method described in Example 23 except that of the dispersion solutions prepared in Example 23, 1 part by mass of the solution A, 2 parts by mass of the solution B, and 4 parts by mass of the solution C were mixed to prepare a coating solution.

Test Example 12

(Light Resistance of Background)

TABLE 14

| | Light resistance of background | | | | |
|---|---|---|---|---|---|
| | Before test | 6 hours (B) | 12 hours (B) | 6 hours (Y) | 12 hours (Y) |
| Example 23 | 0.09 | 0.10 | 0.13 | 0.19 | 0.26 |
| Example 24 | 0.09 | 0.11 | 0.13 | 0.18 | 0.25 |
| Comparative Example 10 | 0.06 | 0.08 | 0.13 | 0.15 | 0.26 |

Light resistance tester (trade name: UV Long-Life Fade Meter model U48, manufactured by Suga Test Instruments Co., Ltd.)

As is evident from the results of Table 14, the comparison between Examples 23 to 24 and Comparative Example 10 showed that the recording material of the present invention had exceedingly good light resistance of the background and was hardly altered even by the addition of the image stabilizer, compared with the image stabilizer-free samples. Thus, the recording material was almost free from usually expected adverse effect caused by the addition.

Test Example 13

(Heat Resistance of Image)

TABLE 15

| | Before test | | Image stabilizer | |
|---|---|---|---|---|
| | Added | Not added | Added | Not added |
| Example 23 | 1.33 | 1.28 | 1.10 | 0.51 |
| Example 24 | 1.30 | (Comparative Example 10) | 1.06 | (Comparative Example 10) |

Thermal printing tester (trade name: model TH-PMH, manufactured by Ohkura Electric Co., Ltd.)
Color development conditions (printing voltage: 17 V, Pulse width: 1.8 ms)
Thermostat (trade name: DK-400, manufactured by Yamato Scientific Co., Ltd)
Test conditions (100° C., 24 hours)

As is evident from the results of Table 15, the comparison between Examples 23 to 24 and Comparative Example 10 showed that the heat resistance of the image was significantly improved in Examples 23 to 24.

Example 25

(Color-developing Agent Formulation; Preparation Thermal Recording Paper)

| | |
|---|---|
| Dispersion solution of color-forming compound (solution A) | |
| 3-di-n-butylamino-6-methyl-7-anilinofluoran | 16 parts |
| 10% aqueous solution of polyvinyl alcohol | 84 parts |
| Dispersion solution of color-developing agent 1 (solution B) | |
| N-(2-hydroxyphenyl)-cinnamoylamide | 16 parts |
| 10% aqueous solution of polyvinyl alcohol | 84 parts |
| Dispersion solution of color-developing agent 2 (solution C) | |
| 4-hydroxy-4'-isopropoxydiphenylsulfone | 16 parts |
| 10% aqueous solution of polyvinyl alcohol | 84 parts |

-continued

| | |
|---|---|
| Dispersion solution of filler (solution D) | |
| Calcium carbonate | 27.8 parts |
| 10% aqueous solution of polyvinyl alcohol | 26.2 parts |
| Water | 71 parts |

First, each mixture having the composition of the solution A, B, C, or D was sufficiently ground with a sand grinder to prepare dispersion solutions of the components of the solutions A to D. 1 part by mass of the solution A, 0.5 part by mass of the solution B, 1.5 parts by mass of the solution C, and 4 parts by mass of the solution D were mixed to prepare a coating solution. This coating solution was applied to white paper using a wire rod (manufactured by Webster, Wire Bar No. 12), and the paper was dried. Then, calendering treatment was performed to prepare thermal recording paper (coating solution: approximately 5.5 g/m$^2$ in terms of dry mass).

Example 26

Thermal recording paper was prepared by the method described in Example 25 except that the composition of each dispersion solution of Example 25 was changed to 1 part by mass of the solution A, 1.0 part by mass of the solution B, 1.0 part by mass of the solution and 4 parts by mass of the solution D.

Example 27

Thermal recording paper was prepared by the method described in Example 25 except that the composition of each dispersion solution of Example 25 was changed to 1 part by mass of the solution A, 0.5 part by mass of the solution B, 1.5 parts by mass of the solution C, and 4 parts by mass of the solution D.

Example 28

(Preparation of Thermal Recording Paper)

| | |
|---|---|
| Dispersion solution of color-forming compound (solution A) | |
| 3-di-n-butylamino-6-methyl-7-anilinofluoran | 16 parts |
| 10% aqueous solution of polyvinyl alcohol | 84 parts |
| Dispersion solution of color-developing agent 1 (solution B) | |
| N-(2-hydroxyphenyl)-cinnamoylamide | 16 parts |
| 10% aqueous solution of polyvinyl alcohol | 84 parts |
| Dispersion solution of color-developing agent 3 (solution E) | |
| D-90 (color-developing agent for thermal recording paper manufactured by Nippon Soda Co., Ltd.) | 16 parts |
| 10% aqueous solution of polyvinyl alcohol | 84 parts |
| Dispersion solution of filler (solution D) | |
| Calcium carbonate | 27.8 parts |
| 10% aqueous solution of polyvinyl alcohol | 26.2 parts |
| Water | 71 parts |

First, each mixture having the composition of the solution A, B, D, or E was sufficiently ground with a sand grinder to prepare dispersion solutions of the components of the solutions A, B, D, and E. 1 part by mass of the solution A, 0.5 part by mass of the solution B, 1.5 parts by mass of the solution E, and 4 parts by mass of the solution D were mixed to prepare a coating solution. This coating solution was applied to white paper using a wire rod (manufactured by Webster, Wire Bar No. 12), and the paper was dried. Then, calendering treatment was performed to prepare thermal recording paper (coating solution: approximately 5.5 g/m$^2$ in terms of dry mass).

Example 29

Thermal recording paper was prepared by the method described in Example 28 except that the composition of each dispersion solution of Example 28 was changed to 1 part by mass of the solution A, 1.0 part by mass of the solution B, 1.0 part by mass of the solution E, and 4 parts by mass of the solution D.

Example 30

Thermal recording paper was prepared by the method described in Example 28 except that the composition of each dispersion solution of Example 28 was changed to 1 part by mass of the solution A, 0.5 part by mass of the solution B, 1.5 parts by mass of the solution E, and 4 parts by mass of the solution D.

Comparative Example 11

Thermal recording paper was prepared by the method described in Example 28 except that the composition of each dispersion solution of Example 28 was changed to 1 part by mass of the solution A, 1.0 part by mass of the solution B, and 4 parts by mass of the solution D.

Comparative Example 12

Thermal recording paper was prepared by the method described in Example 28 except that the composition of each dispersion solution of Example 28 was changed to 1 part by mass of the solution A, 1.0 part by mass of the solution C, and 4 parts by mass of the solution D.

Comparative Example 13

Thermal recording paper was prepared by the method described in Example 28 except that the composition of each dispersion solution of Example 28 was changed to 1 part by mass of the solution A, 1.5 parts by mass of the solution E, and 4 parts by mass of the solution D.

Test Example 14

(Dynamic Color-Developing Sensitivity)

TABLE 16

| | Pulse width | |
|---|---|---|
| | 1.1 ms | 1.25 ms |
| Example 25 | 0.96 | 1.13 |
| Example 26 | 0.94 | 1.17 |
| Example 27 | 0.96 | 1.12 |
| Comparative Example 12 | 0.96 | 1.18 |

Figure 4:
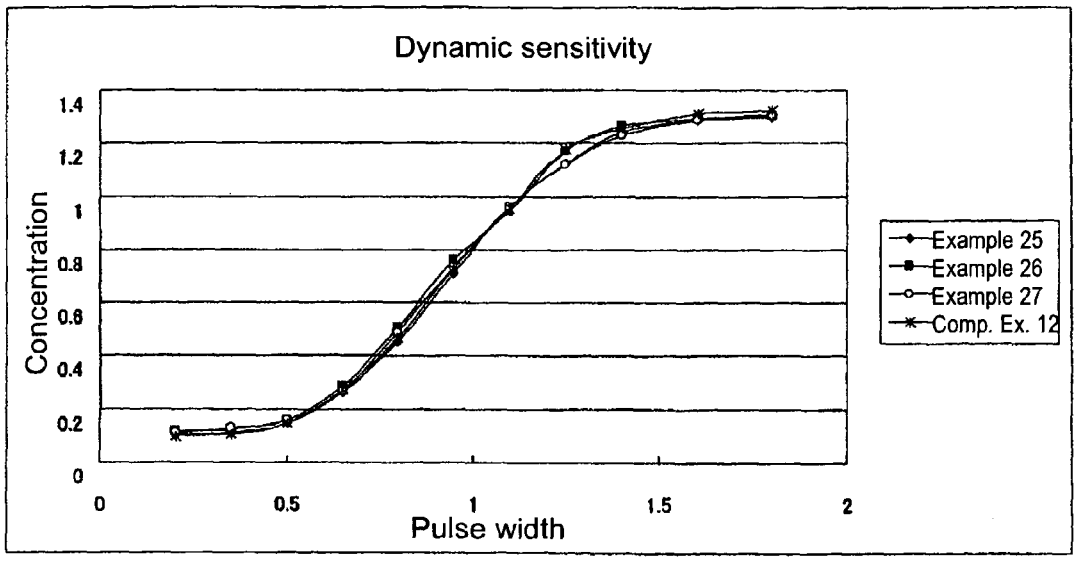
FIG. 4 is a diagram showing results of a dynamic color-developing sensitivity test using each recording paper prepared in Examples 25 to 27 and Comparative Example 12.

Thermal printing tester (trade name: model TH-PMH, manufactured by Ohkura Electric Co., Ltd.)
Printing voltage: 17 V, Pulse width: 0.2, 0.35, 0.5, 0.65, 0.8, 0.95, 1.1, 1.25, 1.4, 1.6, 1.8 ms As is evident from Table 16 and FIG. 4, the comparison between Examples 25 to 27 and Comparative Example 12 showed that little adverse effect was caused even by the addition of the compound of the present invention to the color-developing agent 2, and favorable results were obtained even in the dynamic sensitivity test.

TABLE 17

| | Pulse width | |
|---|---|---|
| | 1.1 ms | 1.25 ms |
| Example 28 | 0.61 | 0.80 |
| Example 29 | 0.73 | 0.92 |
| Example 30 | 0.83 | 1.04 |
| Comparative Example 13 | 0.46 | 0.60 |

Figure 5:
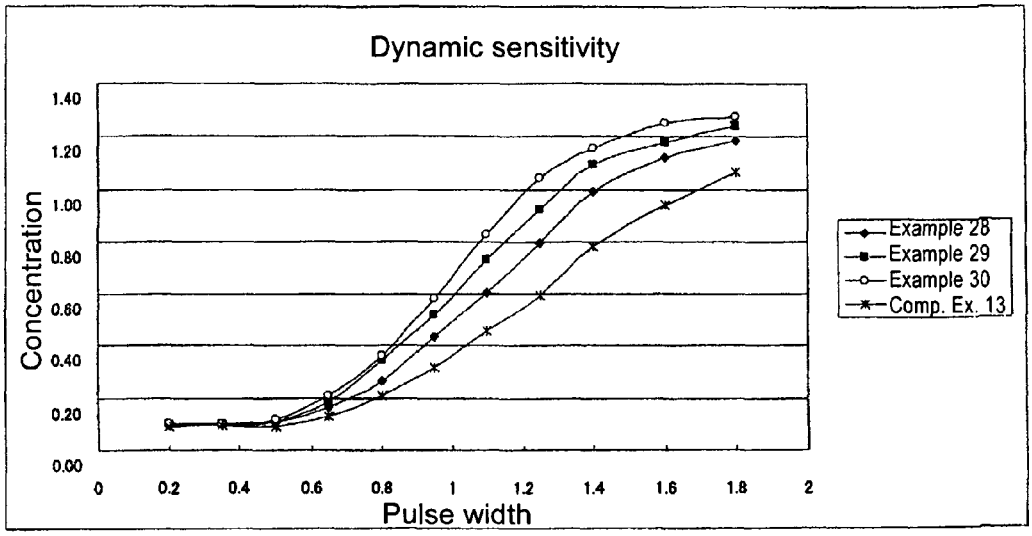
FIG. 5 is a diagram showing results of a dynamic color-developing sensitivity test using each recording paper prepared in Examples 28 to 30 and Comparative Example 13.

Thermal printing tester (trade name:, model TH-PMH, manufactured by Ohkura Electric Co., Ltd.)
Printing voltage: 17 V, Pulse width: 0.2, 0.35, 0.5, 0.65, 0.8, 0.95, 1.1, 1.25, 1.4, 1.6, 1.8 ms As is evident from Table 17 and FIG. 5, the comparison between Examples 28 to 30 and Comparative Example 13 showed that the sensitivity was only slightly reduced even by the addition of the color-developing agent 3 to the compound of the present invention, and favorable results were obtained even in the dynamic sensitivity test.

Test Example 15

(Heat Resistance of Image)

TABLE 18

| | Before test | After test |
|---|---|---|
| Example 25 | 1.34 | 1.23 |
| Example 26 | 1.33 | 1.34 |
| Example 27 | 1.34 | 1.42 |
| Example 28 | 1.30 | 0.99 |
| Example 29 | 1.28 | 1.13 |
| Example 30 | 1.21 | 1.28 |
| Comparative Example 11 | 1.28 | 0.51 |

Thermal printing tester (trade name: model TH-PMH, manufactured by Ohkura Electric Co., Ltd.)
Color development conditions (printing voltage: 17 V, Pulse width: 1.8 ms)
Thermostat (trade name: DK-400, manufactured by Yamato Scientific Co., Ltd)
Test conditions (100° C., 24 hours)

As is evident from the results of Table 18, the comparison between Examples 25 to 30 and Comparative Example 11 showed that the heat resistance of the image was significantly improved in Examples 25 to 30.

The invention claimed is:

1. A recording material containing fluoran color-forming compound, the recording material containing at least one compound represented by formula (I):

(I)

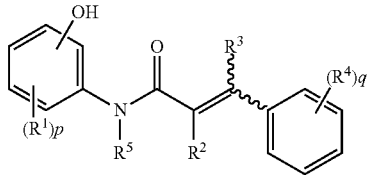

wherein $R^1$ and $R^4$ each independently represent a hydroxy group, a halogen atom, a $C_1$-$C_6$ alkyl group, or a $C_1$-$C_6$ alkoxy group;

p represents 0 or any integer of 1 to 4;

q represents 0 or any integer of 1 to 5;

when p and q represent 2 or more, each of $R^1$ and each of $R^4$ are the same or different;

$R^2$ and $R^3$ each independently represent a hydrogen atom or a $C_1$-$C_6$ alkyl group;

$R^5$ represents a hydrogen atom, a $C_1$-$C_6$ alkyl group, an optionally substituted phenyl group, or an optionally substituted benzyl group; and a bond represented by a wavy line represents a geometric isomer or a mixture thereof, and, as an additive, either at least one compound represented by formula (IV):

(IV)

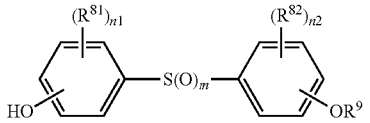

wherein $R^{81}$ and $R^{82}$ each independently represent a halogen atom, a $C_1$-$C_6$ alkyl group, or a $C_2$-$C_6$ alkenyl group;

n1 and n2 each independently represent 0 or any integer of 1 to 4;

m represents 0 or any integer of 1 to 2; and $R^9$ represents a $C_1$-$C_6$ alkyl group or at least one compound represented by formula (V):

(V)

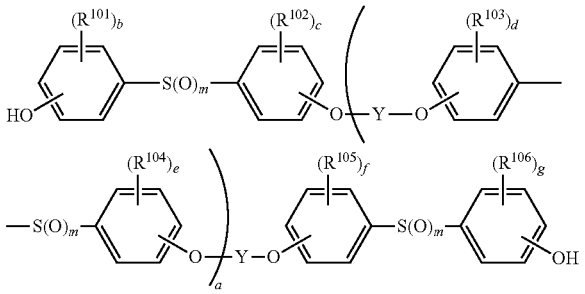

wherein $R^{101}$ to $R^{106}$ each independently represent a halogen atom, a $C_1$-$C_6$ alkyl group, or a $C_2$-$C_6$ alkenyl group;

Y represents a linear or branched, saturated or unsaturated $C_1$-$C_{12}$ hydrocarbon group optionally having an ether bond, or the following formula:

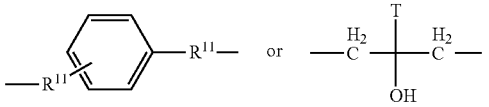

wherein $R^{11}$ represents a methylene group or an ethylene group, and T represents a hydrogen atom or a $C_1$-$C_4$ alkyl group;

b, c, d, e, f, and g each independently represent 0 or any integer of 1 to 4;

m represents 0 or any integer of 1 to 2; and a represents 0 or any integer of 1 to 10.

2. The recording material according to claim 1, wherein the compound represented by formula (I) is a compound represented by formula (II):

(II)

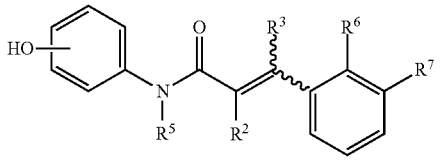

wherein $R^2$ to $R^5$ are the same as $R^2$ to $R^5$ in the formula (I);

$R^7$ represents a $C_1$-$C_4$ alkyl group or a $C_1$-$C_4$ alkoxy group; and $R^6$ represents a hydrogen atom when $R^7$ represents a $C_1$-$C_4$ alkyl group, and represents a $C_1$-$C_4$ alkoxy group when $R^7$ represents a $C_1$-$C_4$ alkoxy group.

3. The recording material according to claim 1, wherein the compound represented by formula (I) is a compound represented by formula (III):

(III)

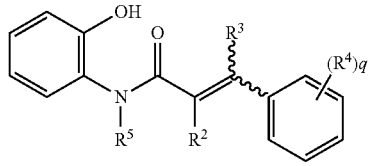

wherein $R^2$ to $R^5$ are the same as $R^2$ to $R^5$ in the formula (I).

4. The recording material according to claim 1, wherein the compound represented by formula (IV) is a compound represented by formula (VI):

(VI)

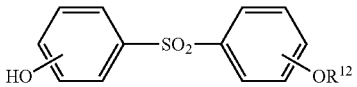

wherein $R^{12}$ represents a hydrogen atom, a $C_1$-$C_6$ alkyl group, or a $C_2$-$C_6$ alkenyl group.

5. The recording material according to claim 1, wherein the compound represented by formula (V) is a compound represented by formula (VII):

(VII)

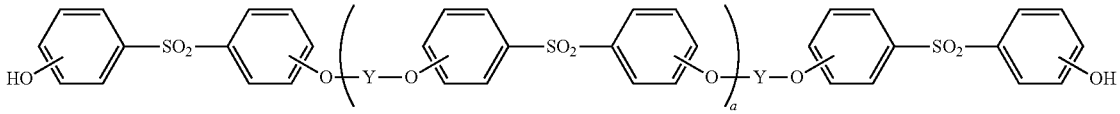

wherein

Y represents a linear or branched, saturated or unsaturated $C_1$-$C_{12}$ hydrocarbon group optionally having an ether bond or the following formula:

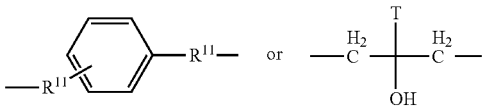

wherein $R^{11}$ represents a methylene group or an ethylene group, and T represents a hydrogen atom or a $C_1$-$C_4$ alkyl group; and a represents 0 or any integer of 1 to 10.

6. A recording sheet having a recording material layer formed from the recording material according to claim 1 on a support.

7. A recording material containing a fluoran color-forming compound, the recording material containing at least one compound represented by formula (I):

(I)

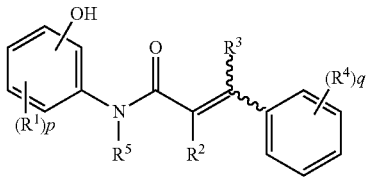

wherein $R^1$ and $R^4$ each independently represent a hydroxy group, a halogen atom, a $C_1$-$C_6$ alkyl group, or a $C_1$-$C_6$ alkoxy group;

p represents 0 or any integer of 1 to 4;

q represents 0 or any integer of 1 to 5;

when p and q represent 2 or more, each of $R^1$ and each of $R^4$ are the same or different;

$R^2$ and $R^3$ each independently represent a hydrogen atom or a $C_1$-$C_6$ alkyl group;

$R^5$ represents a hydrogen atom, a $C_1$-$C_6$ alkyl group, an optionally substituted phenyl group, or an optionally substituted benzyl group; and a bond represented by a wavy line represents a geometric isomer or a mixture thereof, and, as an additive, a hindered phenol compound represented by formula (VIII):

(VIII)

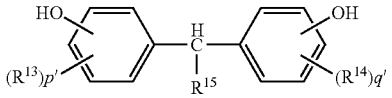

wherein $R^{13}$ and $R^{14}$ each independently represent a $C_1$-$C_6$ alkyl group; p' and q' each independently represent any integer of 1 to 4;

when p' and q' represent 2 or more, each of $R^{13}$ and each of $R^{14}$ are the same or different, provided that at least one of $R^{13}$ and $R^{14}$ represents a $C_1$-$C_6$ alkyl group bonded via secondary or tertiary carbon to the ortho position of the hydroxy group; and $R^{15}$ represents a compound represented by formula (IX):

(IX)

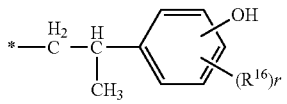

wherein $R^{16}$ represents a $C_3$-$C_6$ alkyl group;

r represents 0 or any integer of 1 to 4; and

* represents a binding position.

8. The recording material according to claim 7, wherein the compound represented by formula (I) is a compound represented by formula (II):

(II)

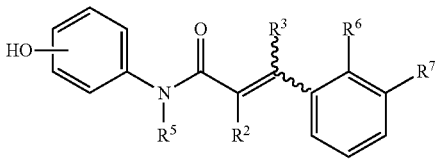

wherein $R^2$ to $R^5$ are the same as $R^2$ to $R^5$ in the formula (I);

$R^7$ represents a $C_1$-$C_4$ alkyl group or a $C_1$-$C_4$ alkoxy group; and $R^6$ represents a hydrogen atom when $R^7$ represents a $C_1$-$C_4$ alkyl group, and represents a $C_1$-$C_4$ alkoxy group when $R^7$ represents a $C_1$-$C_4$ alkoxy group.

9. The recording material according to claim 7, wherein the compound represented by formula (I) is a compound represented by formula (III):

(III)

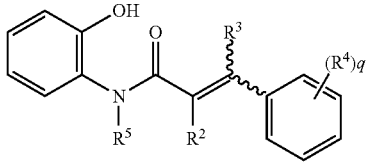

wherein $R^2$ to $R^5$ are the same as $R^2$ to $R^5$ in the formula (I).

10. A recording sheet having a recording material layer formed from the recording material according to claim 7 on a support.

11. A recording material containing a fluoran color-forming compound, the recording material containing at least one compound represented by formula (I):

(I)

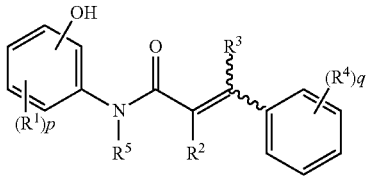

wherein $R^1$ and $R^4$ each independently represent a hydroxy group, a halogen atom, a $C_1$-$C_6$ alkyl group, or a $C_1$-$C_6$ alkoxy group;

p represents 0 or any integer of 1 to 4;

q represents 0 or any integer of 1 to 5;

when p and q represent 2 or more, each of $R^1$ and each of $R^4$ are the same or different;

$R^2$ and $R^3$ each independently represent a hydrogen atom or a $C_1$-$C_6$ alkyl group;

$R^5$ represents a hydrogen atom, a $C_1$-$C_6$ alkyl group, an optionally substituted phenyl group, or an optionally substituted benzyl group; and a bond represented by a wavy line represents a geometric isomer or a mixture thereof, and, as an additive, at least one kind selected from the group consisting of 2-naphthylbenzyl ether, di(4-methylbenzyl) oxalate, 1,2-bis-(3-ethylphenoxy)ethane, 1,2-bis(phenoxymethyl)benzene, and diphenylsulfone.

12. The recording material according to claim 11, wherein the compound represented by formula (I) is a compound represented by formula (II):

(II)

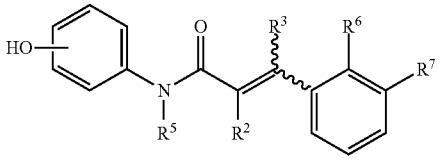

wherein $R^2$ to $R^5$ are the same as $R^2$ to $R^5$ in the formula (I);

$R^7$ represents a $C_1$-$C_4$ alkyl group or a $C_1$-$C_4$ alkoxy group; and $R^6$ represents a hydrogen atom when $R^7$ represents a $C_1$-$C_4$ alkyl group, and represents a $C_1$-$C_4$ alkoxy group when $R^7$ represents a $C_1$-$C_4$ alkoxy group.

13. The recording material according to claim 11, wherein the compound represented by formula (I) is a compound represented by formula (III):

(III)

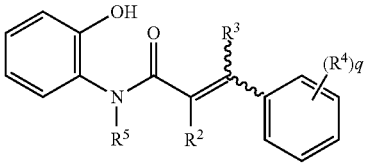

wherein $R^2$ to $R^5$ are the same as $R^2$ to $R^5$ in the formula (I).

14. A recording sheet having a recording material layer formed from the recording material according to claim 11 on a support.

* * * * *